US011577952B2

(12) United States Patent
Lundberg et al.

(10) Patent No.: US 11,577,952 B2
(45) Date of Patent: Feb. 14, 2023

(54) METHOD AND APPARATUS FOR BLENDING IN A CUP

(71) Applicant: MANITOWOC FOODSERVICE COMPANIES, LLC, New Port Richey, FL (US)

(72) Inventors: Kenneth L. Lundberg, Land O Lakes, FL (US); Marc-Alexander Lange, Highland Beach, FL (US); Dennies Bergman, Hanover (DE); Joseph Knauss, Delray Beach, FL (US)

(73) Assignee: MANITOWOC FOODSERVICE COMPANIES, LLC, New Port Richey, FL (US)

( * ) Notice: Subject to any disclaimer, the term of this patent is extended or adjusted under 35 U.S.C. 154(b) by 328 days.

(21) Appl. No.: 16/589,921

(22) Filed: Oct. 1, 2019

(65) Prior Publication Data

US 2021/0094819 A1 Apr. 1, 2021

(51) Int. Cl.

| | |
|---|---|
| ***B67D 3/00*** | (2006.01) |
| ***B67D 1/00*** | (2006.01) |
| ***B01F 35/42*** | (2022.01) |
| ***B01F 101/14*** | (2022.01) |

(52) U.S. Cl.

CPC ..... *B67D 3/0083* (2013.01); *B01F 35/42* (2022.01); *B67D 1/0053* (2013.01); *B01F 2101/14* (2022.01)

(58) Field of Classification Search

CPC ..... B67D 3/0083; A47J 2043/04472; A47J 2043/04463; A47J 2043/04454; B01F 15/00733; B01F 15/0074; B01F 15/00753; B01F 35/42; B01F 35/421; B01F 35/423

USPC ..... 366/347

See application file for complete search history.

(56) References Cited

U.S. PATENT DOCUMENTS

| | | | | | |
|---|---|---|---|---|---|
| 442,698 | A | * | 12/1890 | Yates | A61M 37/0069 604/57 |
| 2,168,429 | A | | 9/1936 | Meyers | |
| 3,245,664 | A | * | 4/1966 | Gatheridge | A47J 43/044 366/151.2 |
| 4,637,221 | A | | 1/1987 | Levine | |
| D315,478 | S | * | 3/1991 | Liggens | D7/667 |
| 5,439,289 | A | | 8/1995 | Neilson | |
| 5,727,712 | A | * | 3/1998 | Costello | A47G 19/2211 220/703 |
| 5,803,377 | A | | 9/1998 | Farrell | |

(Continued)

FOREIGN PATENT DOCUMENTS

WO 20080105107 A1 9/2008

OTHER PUBLICATIONS

Fresh Blender—Integrated Beverage Systems; Installation, Operation and Maintenance Manual; Multiplex; Aug. 17, 2018; pp. 95-156.

(Continued)

*Primary Examiner* — Timothy L Maust

(74) *Attorney, Agent, or Firm* — Ohlandt, Greeley, Ruggiero and Perle, LLP

(57) ABSTRACT

A cup holder assembly includes a plurality of contacts that are configured to contact a cup so that a majority of an opening into the cup is uncovered by the cup holder, and the plurality of contacts are connectable to one or more cup holder guide rods of an assembly that dispenses and mixes or blends beverages.

14 Claims, 34 Drawing Sheets

(56) References Cited

U.S. PATENT DOCUMENTS

| | | | | |
|---|---|---|---|---|
| 6,520,658 | B2 | 2/2003 | Chen | |
| 7,144,150 | B2 | 12/2006 | Farrell | |
| 7,520,662 | B2 | 4/2009 | Farrell | |
| 8,074,837 | B2 | 12/2011 | Nevarez et al. | |
| 8,459,176 | B2 | 6/2013 | Nevarez et al. | |
| 8,534,501 | B2 | 9/2013 | Nevarez et al. | |
| 8,606,396 | B2 | 12/2013 | Claesson et al. | |
| D699,074 | S * | 2/2014 | Morrison | D7/412 |
| 8,672,534 | B2 | 3/2014 | Nevarez et al. | |
| 8,685,477 | B2 | 4/2014 | Almblad et al. | |
| 8,863,992 | B2 * | 10/2014 | Wing | F25C 5/20 222/240 |
| D727,096 | S * | 4/2015 | Vu | D7/412 |
| D783,339 | S * | 4/2017 | Mullen | D7/379 |
| 2006/0090429 | A1 * | 5/2006 | Wall | B01D 46/0004 55/418 |
| 2008/0279040 | A1 * | 11/2008 | Neilson | B01F 7/1605 366/176.1 |
| 2009/0205984 | A1 * | 8/2009 | Choi | G11B 33/0427 206/308.1 |
| 2010/0139493 | A1 * | 6/2010 | Nevarez | A47J 31/002 99/275 |
| 2014/0205726 | A1 | 7/2014 | Claesson et al. | |
| 2016/0007801 | A1 | 1/2016 | Bressner et al. | |
| 2016/0016133 | A1 * | 1/2016 | Merritt | B01F 7/161 366/242 |

OTHER PUBLICATIONS

International Search Report dated Nov. 23, 2020 for PCT application No. PCT/US2020/042493.

Written Opinion Report dated Nov. 23, 2020 for PCT application No. PCT/US2020/042493.

International Preliminary Report on Patentability (IPRP) for PCT application No. PCT/US2020/042493.

* cited by examiner

Carriage Script Execution Time

| | Position | Period | Speed | Accumulated Time | | Position | Period | Speed | Accumulated Time |
|---|---|---|---|---|---|---|---|---|---|
| 1 | 1.5 | 0.7 | 100 | 0.7 | 10 | 4.5 | 5.3 | 100 | 21.3 |
| 2 | 6.1 | 3.0 | 100 | 3.7 | 11 | 6.0 | 0.7 | 100 | 22.0 |
| 3 | 6.1 | 3.0 | 100 | 6.7 | 12 | 4.5 | 0.7 | 100 | 22.7 |
| 4 | 4.5 | 2.0 | 100 | 8.7 | 13 | 4.5 | 6.6 | 0 | 29.3 |
| 5 | 4.5 | 3.0 | 100 | 11.7 | 14 | 0.0 | 2.0 | 0 | 31.3 |
| 6 | 6.1 | 0.8 | 100 | 12.5 | 15 | 0.0 | 0.0 | 0 | 0.0 |
| 7 | 3.1 | 1.6 | 100 | 14.1 | 16 | 0.0 | 0.0 | 0 | 0.0 |
| 8 | 6.1 | 1.2 | 100 | 15.3 | 17 | 0.0 | 0.0 | 0 | 0.0 |
| 9 | 4.5 | 0.7 | 100 | 16.0 | 18 | 0.0 | 0.0 | 0 | 0.0 |

Carriage Script Execution Time

| | Position | Period | Speed | Accumulated Time | | Position | Period | Speed | Accumulated Time |
|---|---|---|---|---|---|---|---|---|---|
| 1 | 6.1 | 3.7 | 50 | 3.7 | 10 | 3.1 | 1.2 | 75 | 34.2 |
| 2 | 6.1 | 0.0 | 100 | 3.7 | 11 | 6.1 | 1.2 | 100 | 35.4 |
| 3 | 6.1 | 4.4 | 75 | 8.1 | 12 | 6.1 | 7.1 | 0 | 42.5 |
| 4 | 3.1 | 1.2 | 75 | 9.3 | 13 | 0.0 | 2.5 | 0 | 45.0 |
| 5 | 6.1 | 1.3 | 100 | 10.6 | 14 | 0.0 | 0.0 | 0 | |
| 6 | 6.1 | 10.8 | 75 | 21.4 | 15 | 0.0 | 0.0 | 0 | |
| 7 | 3.0 | 1.3 | 75 | 22.7 | 16 | 0.0 | 0.0 | 0 | |
| 8 | 6.1 | 1.3 | 100 | 24.0 | 17 | 0.0 | 0.0 | 0 | |
| 9 | 6.1 | 9.0 | 75 | 33.0 | 18 | 0.0 | 0.0 | 0 | |

METHOD AND APPARATUS FOR BLENDING IN A CUP

BACKGROUND OF THE DISCLOSURE

1. Field of the Disclosure

The present disclosure is directed to blending or mixing a beverage in a cup. More particularly, the present disclosure relates to a method and apparatus for blending or mixing in a cup having a cup holder and a blending profile therefore.

2. Description of the Related Art

Blending and mixing drinks directly in a cup, in a semi or fully automated fashion, provides improvements in several important areas versus traditional blending methods that use blending pitchers to mix or blend a beverage and then transfer the mixture to a cup. Specifically, there are operational efficiency (no pouring from pitcher to cup), product yield (no wasted product left in pitcher), sanitation (no pitcher to clean), water use (no pitcher to clean) and ergonomic (no pouring from pitcher to cup) advantages.

While blend in cup systems have significant advantages versus traditional blending systems in certain applications, there are areas that can further be improved upon. Traditional blend and mix in cup systems rely on some type of cup cover component that covers the opening of the blending/mixing vessel completely. However, this type of cup cover creates sanitation concerns due to the large surface area of the cup cover that needs to be cleaned after preparation of each beverage. Potentially hazardous microbial growth as well as cross-contamination between drink types can occur with use of this type of cup cover. Thus, an undesirable amount of time and use of water is required for cleaning this type of cup cover. Further, users of self-serve applications of blending systems enjoy watching the beverage being blended while being prepared. However, this type of cup cover that covers the opening of the blending/mixing vessel completely blocks a user's view so that the user cannot see the beverage being blended or mixed in the cup. Accordingly, drink making theater in self-serve applications can also be improved.

Accordingly, there is a need for an apparatus and method of blending or mixing in a cup that overcomes the disadvantages described above.

SUMMARY OF THE DISCLOSURE

The system including the cup holder of the present disclosure is designed to address shortcomings of existing systems and provide additional benefits. The system accomplishes the blending/mixing process with components that minimize the amount of cup holder surface area above the cup. This improves sanitation, minimizes cross-contamination, improves drink making theater in self-serve applications and reduces the amount of water and time required to rinse the cup holder.

In an embodiment of the present disclosure, there is provided a cup holder assembly that includes a plurality of contacts that are configured to contact a cup so that a majority of an opening into the cup is uncovered by the cup holder, and the plurality of contacts are connectable to one or more cup holder guide rods of an assembly that dispenses and mixes or blends beverages.

The above and other objects, features, and advantages of the present disclosure will be apparent and understood by those skilled in the art from the following detailed description, drawings, and accompanying claims. As shown throughout the drawings, like reference numerals designate like or corresponding parts.

DETAILED DESCRIPTION OF THE DISCLOSURE

Figure 1:
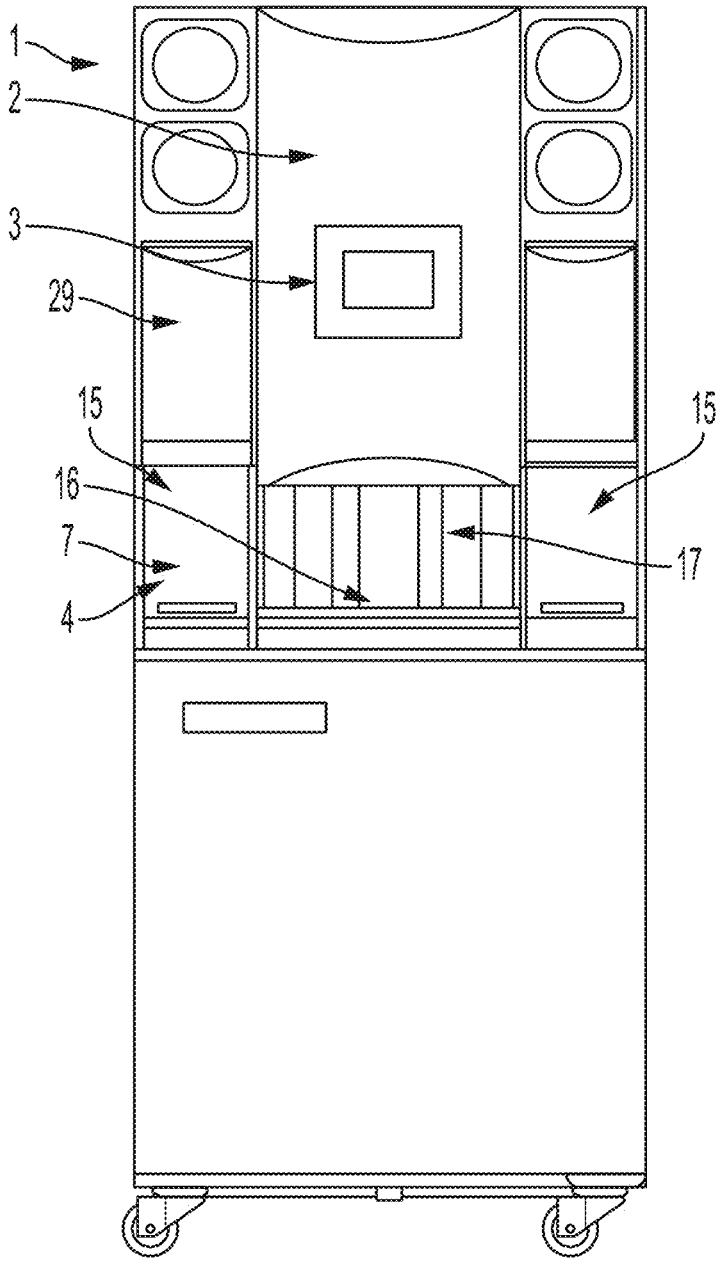
FIG. 1 is a front view of a beverage blending machine according to the present disclosure.
Figure 2:
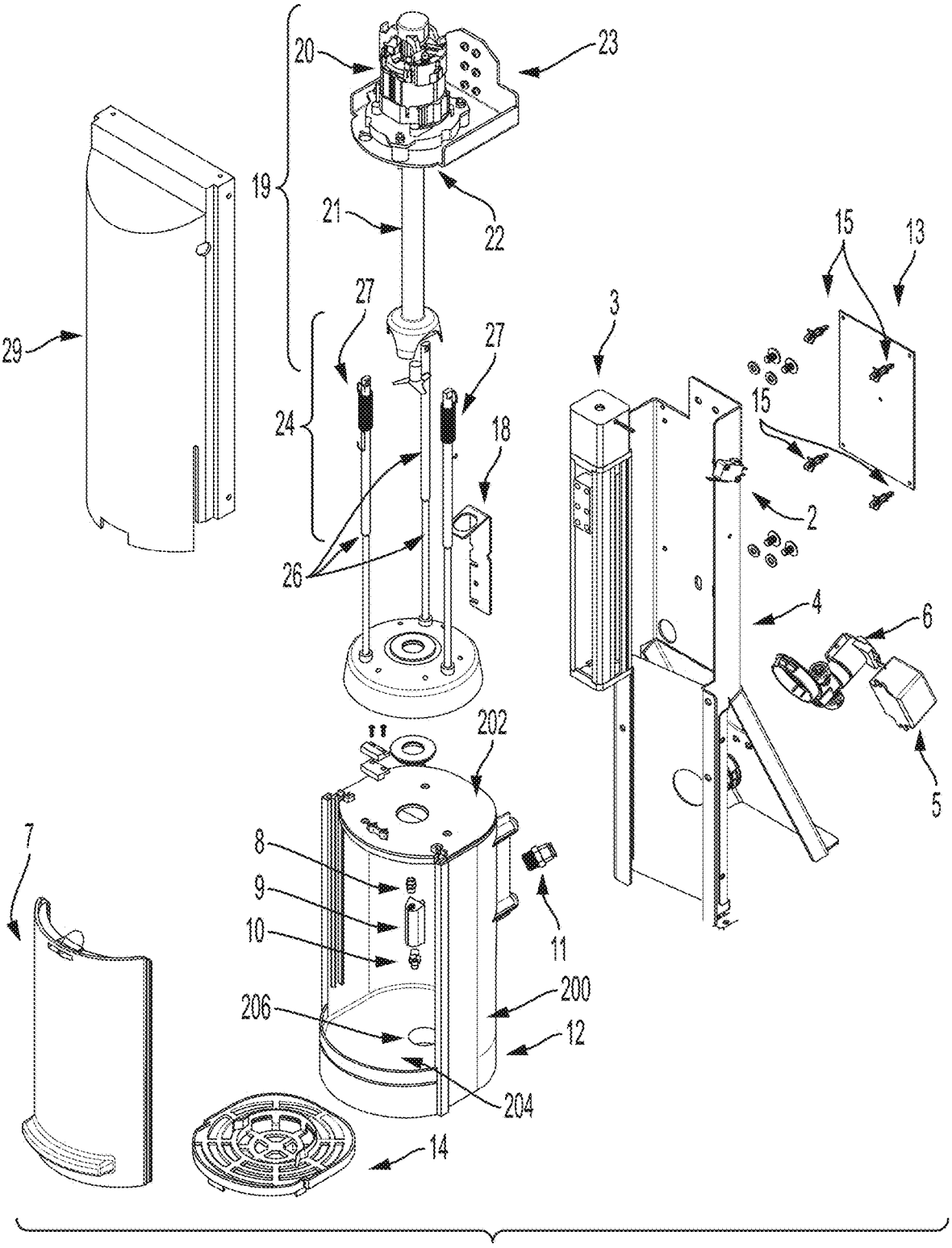
FIG. 2 is an exploded view of a blender module of the beverage blending machine of FIG. 1.

An integrated system for dispensing and blending/mixing beverage flavor/ingredients in a cup, thereby producing a beverage, e.g., a smoothie, generally represented by reference numeral 1 of the present disclosure ("BIC 1") is shown in FIG. 1. BIC 1 can be an assembly that dispenses and mixes beverages 100 of U.S. Pat. No. 8,459,176, filed Dec. 8, 2009, that is hereby incorporated by reference in its entirety. BIC 1 has an integrated assembly that includes a flavor/ingredient dispensing module 17, an ice making and portion control module 2, blender/mixer/cleaner modules 15 and a user interface 3. In operation, a cup is placed on a surface 16 in flavor/ingredient dispensing module 17 to receive ingredients for a beverage and ice from ice making and portion control module 2. After the cup receives the ingredients and ice, the cup is manually moved from surface 16 in flavor/ingredient dispensing module 17 to a first blender/mixer/cleaner module 4 as shown in FIG. 2.

First blender/mixer/cleaner module 4 has a housing 12 for receiving the cup. Housing 12 has a side wall 200, top wall 202 and bottom wall 204 forming an access opening that is selectively covered and uncovered by a door 7. Bottom wall 204 has a drainage aperture 206. A drain cover 14 is positioned inside housing 12 over bottom wall 204 to cover drainage aperture 206.

Spray nozzle manifold 9 is connected to a top nozzle 8 and a bottom nozzle 10. Spray nozzle manifold 9 connects to side wall 200 on a first side of a hole through side wall 200 inside of housing 12. A fitting 11 connects to spray nozzle manifold 9 through the hole through side wall 200 positioning fitting 11 outside of housing 12. Liquid is received by spray nozzle manifold 9 through fitting 11 to generate sprays through top nozzle 8 and bottom nozzle 10.

A cup holder assembly 24 positions a cup holder 900 (FIG. 9) inside of housing 12 so that cup holder guide rods 26 extend through apertures through top wall 202 and connect to cup holder 900. Two of cup holder guide rods 26 each have a blend compartment spring 27. Cup holder guide rods 26 connect cup holder assembly 24 to mixer motor assembly with shaft and blade 19. Mixer motor assembly with shaft and blade 19 has a mixer motor 20 that connects to a mixer shaft with blade assembly 21. Mixer motor 20 is connected to a motor mount 22 to connect to linear rail actuator system 3 by a mixer motor mount bracket 23. Linear rail actuator system 3 is supported by linear actuator bracket 4. A blender control board 13 is connected to linear actuator bracket 4 by board standoff, spacer, PCB, snap in and screw assembly 15. Linear actuator bracket 4 also connects to a relay and a valve, solenoid, water and screw assembly 6.

During operation, door 7 is opened and a cup is positioned in housing 12 on drain cover 14. Door 7 is then closed. Motor mount 22 and mixer motor mount bracket 23 move along linear rail actuator system 3 to move mixer shaft with blade assembly 21 and cup holder assembly 24 from an initial position toward the cup. Once cup holder 900 contacts the cup, mixer shaft with blade assembly 21 can continue to move in the cup while cup holder 900 is maintained in position applying a downward pressure on the cup to minimize or prevent vertical, horizontal and rotational movement of the cup during blending and/or mixing. Mixer motor 20 rotates blades 21*c* (FIG. 36) of mixer shaft with blade assembly 21 in the cup and mixer shaft with blade assembly 21 can be moved vertically. After blending/mixing is complete, motor mount 22 and mixer motor mount bracket 23 move along linear rail actuator system 3 to move mixer shaft with blade assembly 21 and cup holder assembly 24 away from the cup back to the initial position. Door 7 can then be opened and the cup can be removed from the access location, namely, from drain cover 14. Door 7 is closed after the cup is removed, and water is supplied to spray nozzle manifold 9 through fitting 11 to generate sprays through top nozzle 8 and bottom nozzle 10 to clean at least portions of an interior of housing 12, drain cover 14, mixer shaft with blade assembly 21 and cup holder 900. Alternatively, at least portions of an interior of housing 12, drain cover 14, mixer shaft with blade assembly 21 and cup holder 900 can be cleaned by nozzles 1200, 1202 of FIG. 12 and nozzle 3600 of FIGS. 36 and 37 that replace or are in addition to spray nozzle manifold 9 with top nozzle 8 and bottom nozzle 10. After cleaning, door 7 can again be opened to place another cup inside housing 12.

Figure 3:
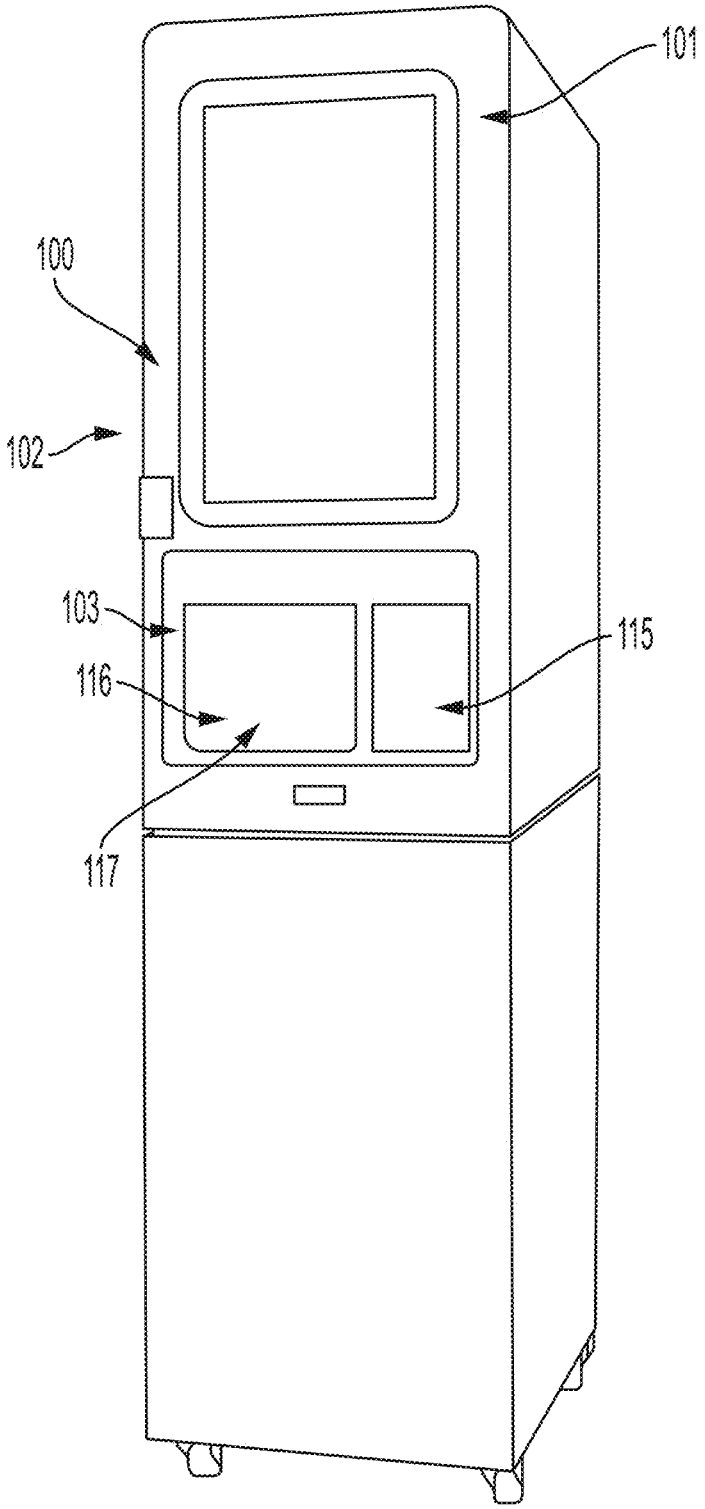
FIG. 3 is a front perspective view of another beverage blending machine according to the present disclosure.

Alternatively, cup holder 900 can be incorporated into a blender assembly 100 (Assembly 100) that is an integrated system for dispensing and blending/mixing beverage flavor/ingredients in a cup, thereby producing a beverage, e.g., a smoothie, as shown in FIG. 3. Assembly 100 has an integrated assembly that includes a flavor/ingredient dispensing module 117, an ice making and portion control module 102, and a blender/mixer/cleaner module 104. Assembly 100 is similar to BIC 1 except Assembly 100 automatically moves the cup after receiving the beverage ingredients from flavor/ingredient dispensing module 117 to blender/mixer/cleaner module 104, and, thus, the same reference numerals will be used. In operation, an empty cup is placed through an opening 103 in housing 101 and placed on a surface of a shuttle 116 at an access location in flavor/ingredient dispensing module 117. The cup receives ingredients for a beverage and ice from ice making and portion control module 102 while positioned on shuttle 116.

Figure 4:
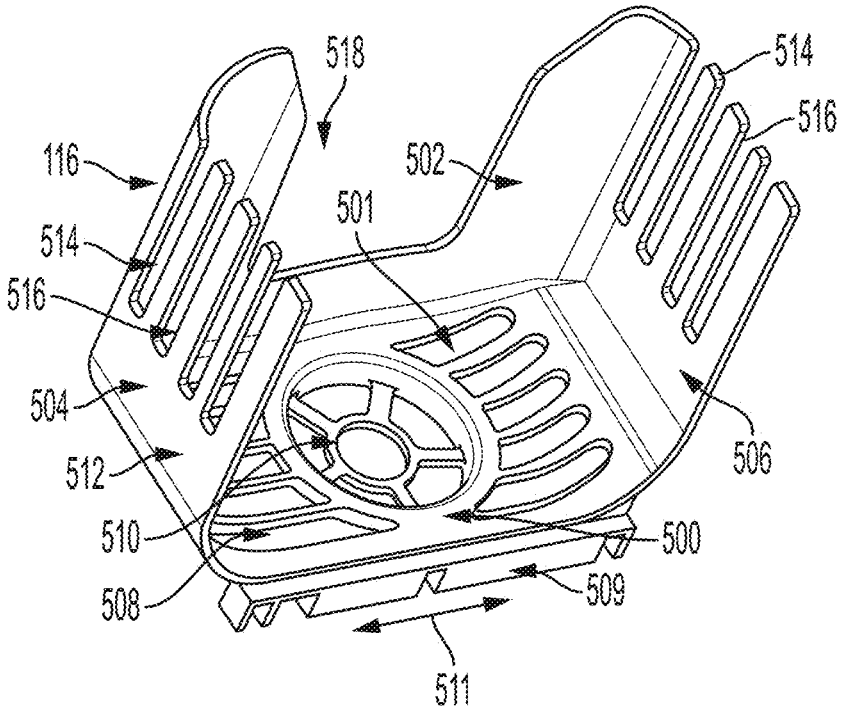
FIG. 4 is a front perspective view of a shuttle of the ice maker and dispenser machine of FIG. 3.
Figure 5:
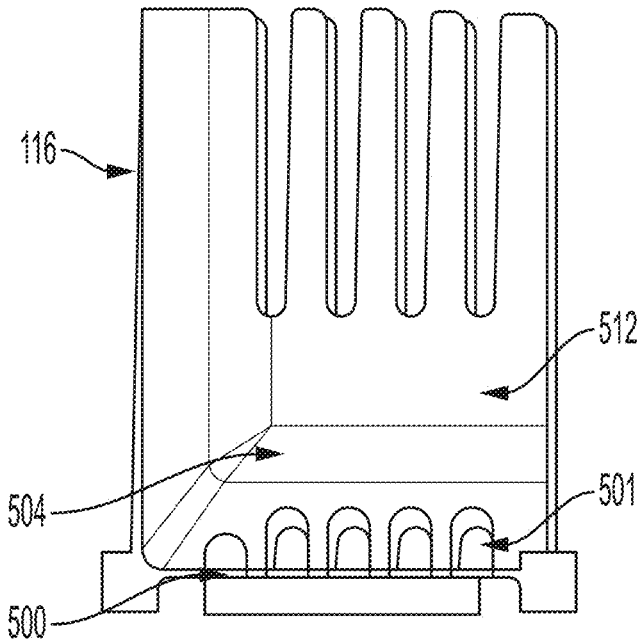
FIG. 5 is a side view of the shuttle of FIG. 4.
Figure 38:
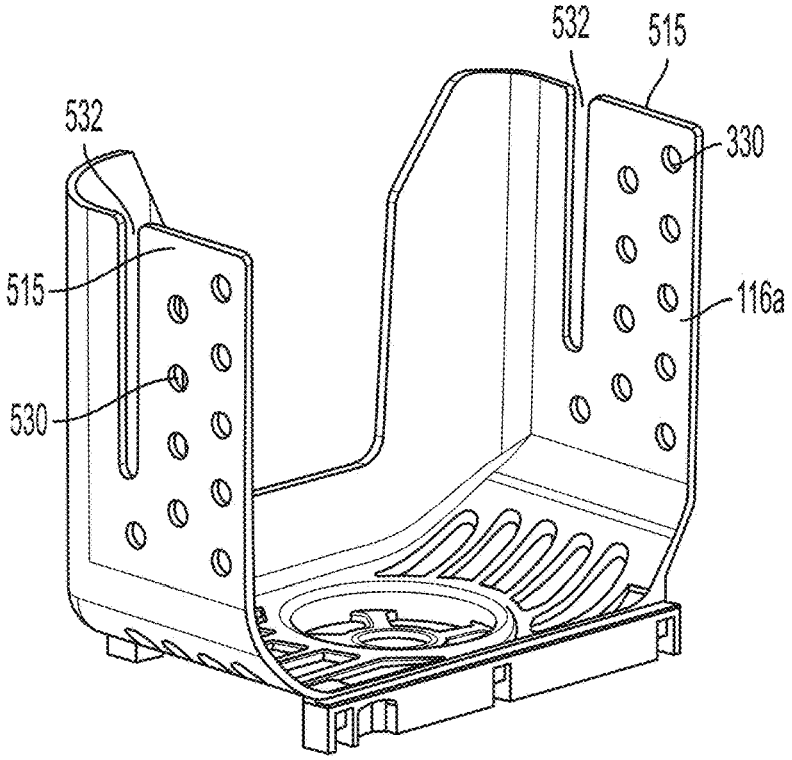
FIG. 38 is a front perspective view of a modified shuttle of the beverage blending machine of FIG. 3.
Figure 39:
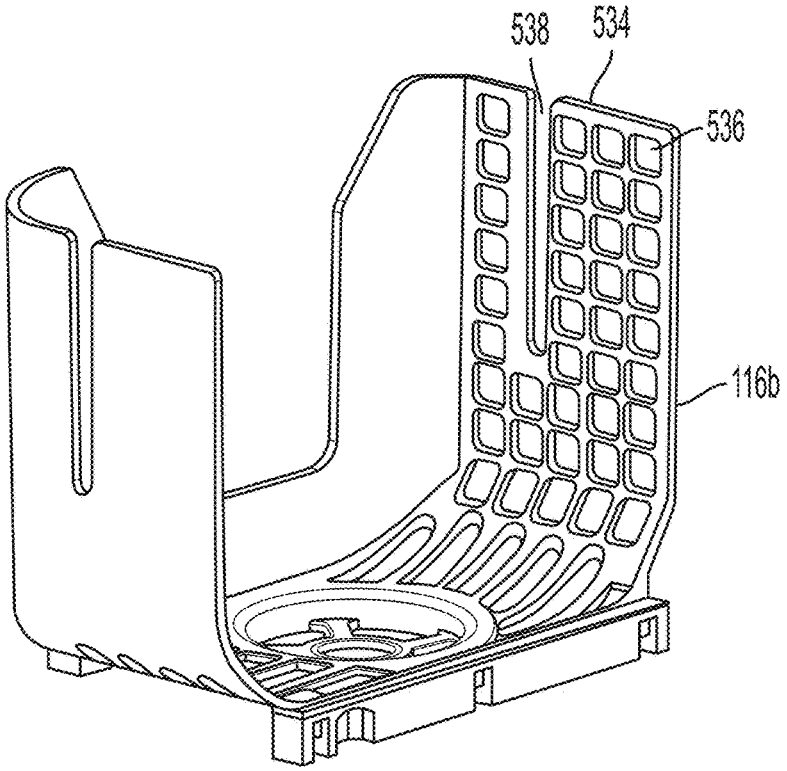
FIG. 39 is a front perspective view of another modified shuttle of the beverage blending machine of FIG. 3.

As shown in FIGS. 4 and 5, shuttle 116 is a unitary structure that forms a bottom wall 500, a back wall 502, a first side wall 504 and a second side wall 506. Bottom wall 500 has an outer grate portion 508 surrounding a center locator grate portion 510 that is depressed relative to outer grate portion 508. Center locator grate portion 510 delineates an area that a user can place the cup to receive beverage ingredients and/or ice when in flavor/ingredient dispensing module 117 and receive mixer shaft with blade assembly that is the same as mixer shaft with blade assembly 21 that passes through cup holder 900 when in blender/mixer/cleaner module 104. Accordingly, the cup rests on the flat surface of center locator grate portion 510. Outer grate portion 508 has openings 501 through bottom wall 500. Bottom wall 500 also has a connection portion 509 to connect to a device for moving shuttle 116 back and forth in the directions shown by arrows 511. First side wall 504 and second side wall 506 are on opposite sides of bottom wall 500. Each of first side wall 504 and second side wall 506 has a bottom portion 512 and fingers 514 extending from bottom portion 512. Openings 501 through bottom wall 500 extend through bottom portion 512. Fingers 514 extend from bottom portion 512 creating spaces 516 between each adjacent set of fingers 514. Openings 501 and spaces 516 create a porous configuration of shuttle 116. Back wall 502 is between first side wall 504 and second side wall 506 and has a U-shaped cutout 518. Referring to FIG. 38, shuttle 116 can be modified to replace fingers 114 with a side panel 515 having circular openings 530 and vertical opening 532. Referring to FIG. 39, shuttle 116 can alternatively be modified to replace fingers 114 with a side panel 534 having square openings 536 and vertical opening 538. Side panels 515, 534 can increase an amount of open area while protecting a user from reaching into the blend area. Side panels 515, 534 do not stop rinse fluid from passing through side panels 515, 534. Side panels 515, 534 need to prevent a finger from going through side panels 515, 534 and have adequate strength, but outside of these characteristics, side panels 515, 534 can be as open as necessary.

Figure 8:
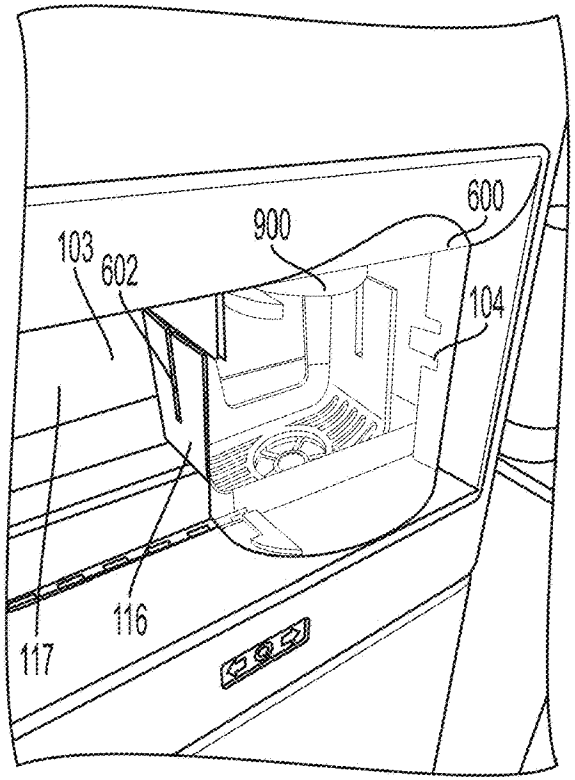
FIG. 8 is a partial front perspective view of the beverage blending machine of FIG. 3 with the shuttle in a third position.
Figure 7:
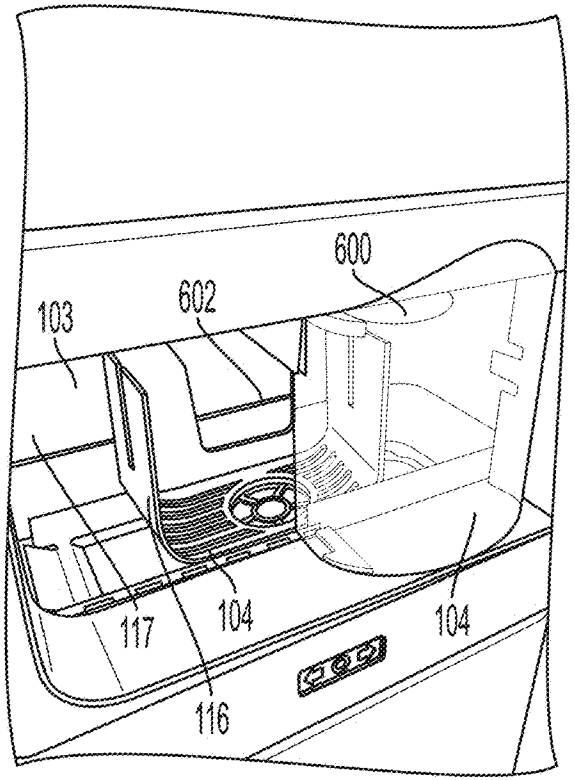
FIG. 7 is a partial front perspective view of the beverage blending machine of FIG. 3 with the shuttle in a second position.
Figure 6:
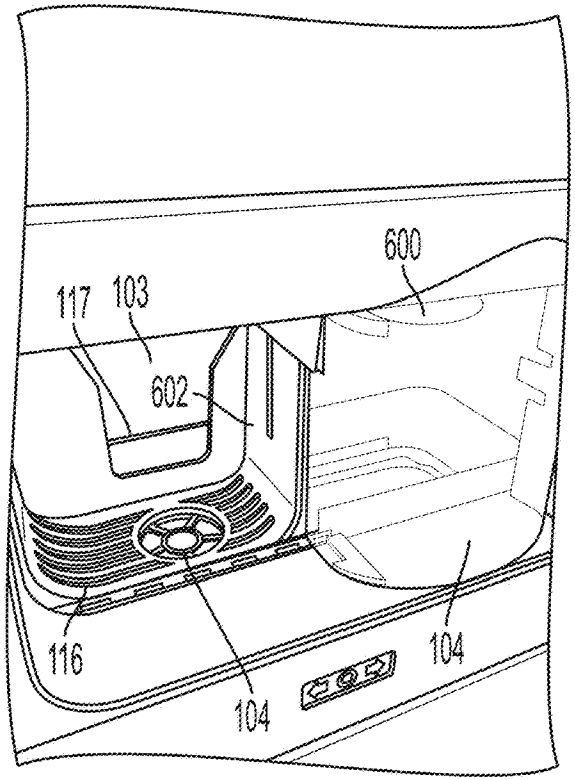
FIG. 6 is a partial front perspective view of the beverage blending machine of FIG. 3 with the shuttle in a first position.

Referring to FIGS. 6-8, blender/mixer/cleaner module 104 has a front wall 600 covering a portion of front opening 103 forming a first opening 602 on a side of front wall 600. After the cup receives the ingredients and ice, the cup is moved by shuttle 116 from flavor/ingredient dispensing module 117, as shown in FIG. 6, through first opening 602, as shown by FIG. 7, to blender/mixer/cleaner module 104, as shown in FIG. 8.

Referring to FIG. 8, blender/mixer/cleaner module 104 has cup holder 900 and mixer motor assembly with shaft and blade 19. The mixer motor assembly with shaft and blade 19 has mixer motor 20 connected to mixer shaft with blade assembly 21. During operation, after cup is moved by shuttle 116 from flavor/ingredient dispensing module 117 to blender/mixer/cleaner module 104, cup holder 900 and mixer shaft with blade assembly 21 are moved towards the cup from an initial position shown in FIG. 8. Motor mount 22 and mixer motor mount bracket 23 move along linear rail actuator system 3 to move mixer shaft with blade assembly 21 and cup holder assembly 24 from an initial position toward the cup. Once cup holder 900 contacts the cup, mixer shaft with blade assembly 21 can continue to move in the cup while cup holder 900 is maintained in position relative to the cup. Cup holder 900 contacts the cup so that it is maintained in position applying a downward pressure on the cup to minimize or prevent vertical, horizontal and rotational movement of the cup during blending and/or mixing. Mixer motor 20 rotates the blade of mixer shaft with blade assembly 21 in the cup and mixer shaft with blade assembly 21 can be moved vertically. Front wall 600 covers a portion of opening 103 to prevent access to moving blades during blending/mixing and to prevent any water sprayed during rinsing from passing out of Assembly 100; however, portions of first opening 602 are exposed through openings 501 through bottom wall 500 that extend through bottom portion 512 and spaces 516 formed by each adjacent set of fingers 514. After blending/mixing is complete, mixer shaft with blade assembly 21 and cup holder 900 are moved away from the cup back to the initial position and the cup is moved by shuttle 116 back to flavor/ingredient dispensing module 117, as shown in FIG. 6, from blender/mixer/cleaner module 104, as shown in FIG. 8, to the access location where a user can remove the cup having the completed beverage for consumption.

Figure 12:
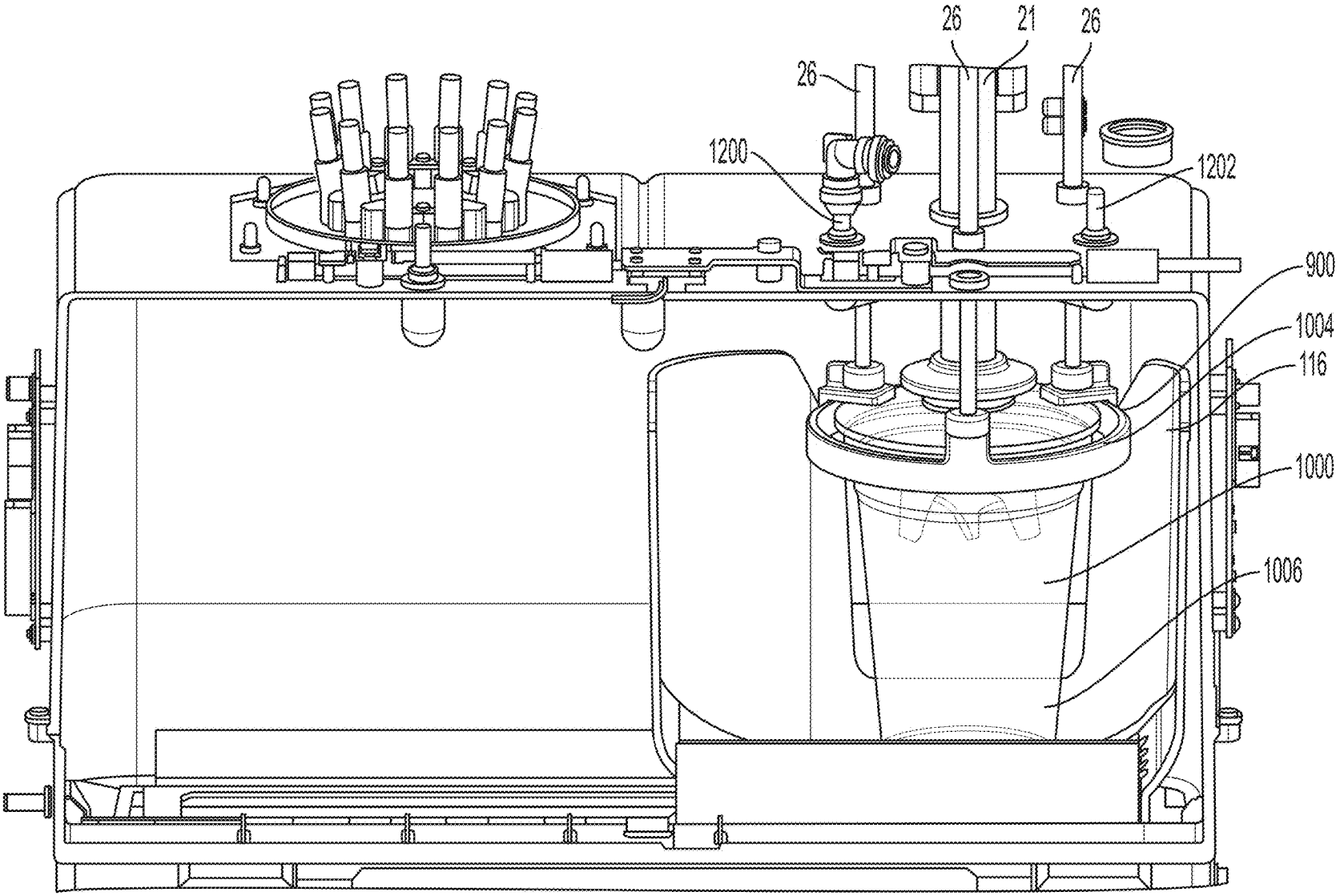
FIG. 12 is a partial front perspective view of the beverage blending machine of FIG. 3 having the cup holder of FIG. 9 connected to cup holder guide rods and positioned on the cup with the cup having the portion of the mixer shaft with blade assembly therein.
Figure 37:
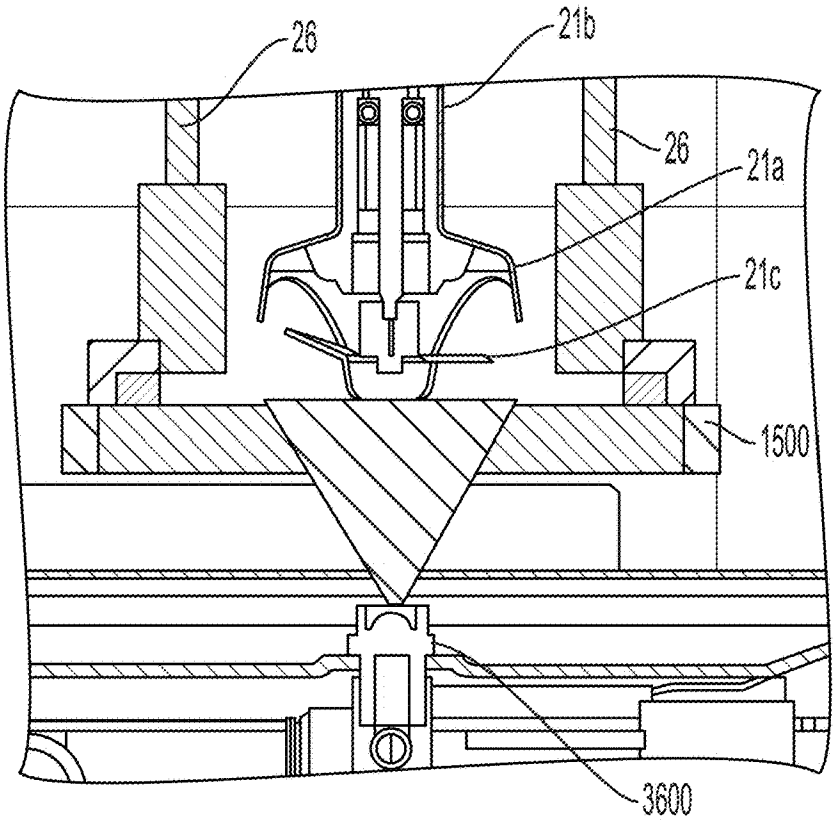
FIG. 37 is a partial view of the beverage blending machine of FIG. 3 having the cup holder of FIG. 16 having nozzles below the cup holder having a second spray angle.
Figure 36:
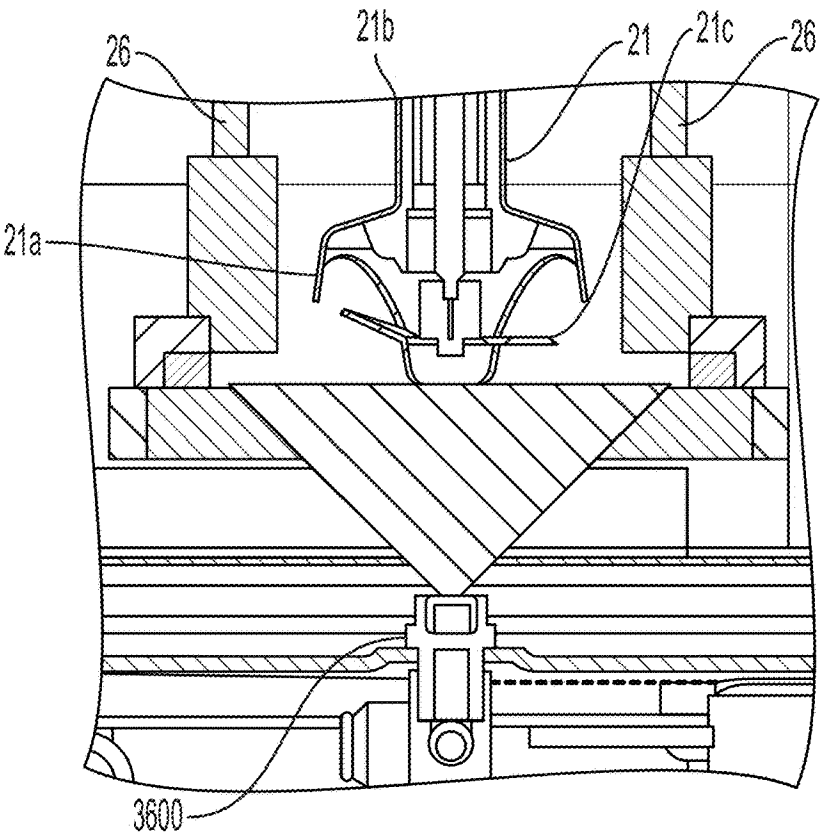
FIG. 36 is a partial view of the beverage blending machine of FIG. 3 having the cup holder of FIG. 16 having nozzles below the cup holder having a first spray angle.

After shuttle 116 is positioned back in flavor/ingredient dispensing module 117, cup holder 900 and mixer shaft with blade assembly 21 are lowered toward a bottom portion of blender/mixer/cleaner module 104 where water is sprayed at cup holder 900 and mixer shaft with blade assembly 21 for cleaning by nozzles 1200, 1202 of FIG. 12 and nozzle 3600 of FIGS. 36 and 37. While the water is sprayed at cup holder 900 and mixer shaft with blade assembly 21, front wall 600 covers the portion of opening 103 to minimize water from splashing out of Assembly 100; however, the portion of first opening 602 is exposed through spaces 516 of second side wall 506 formed by each adjacent set of fingers 514 and openings 501 that extend through bottom wall 500 and bottom portion 512 of second side wall 506. After cleaning, cup holder 900 and mixer shaft with blade assembly 21 are moved to the initial position.

Figure 9:
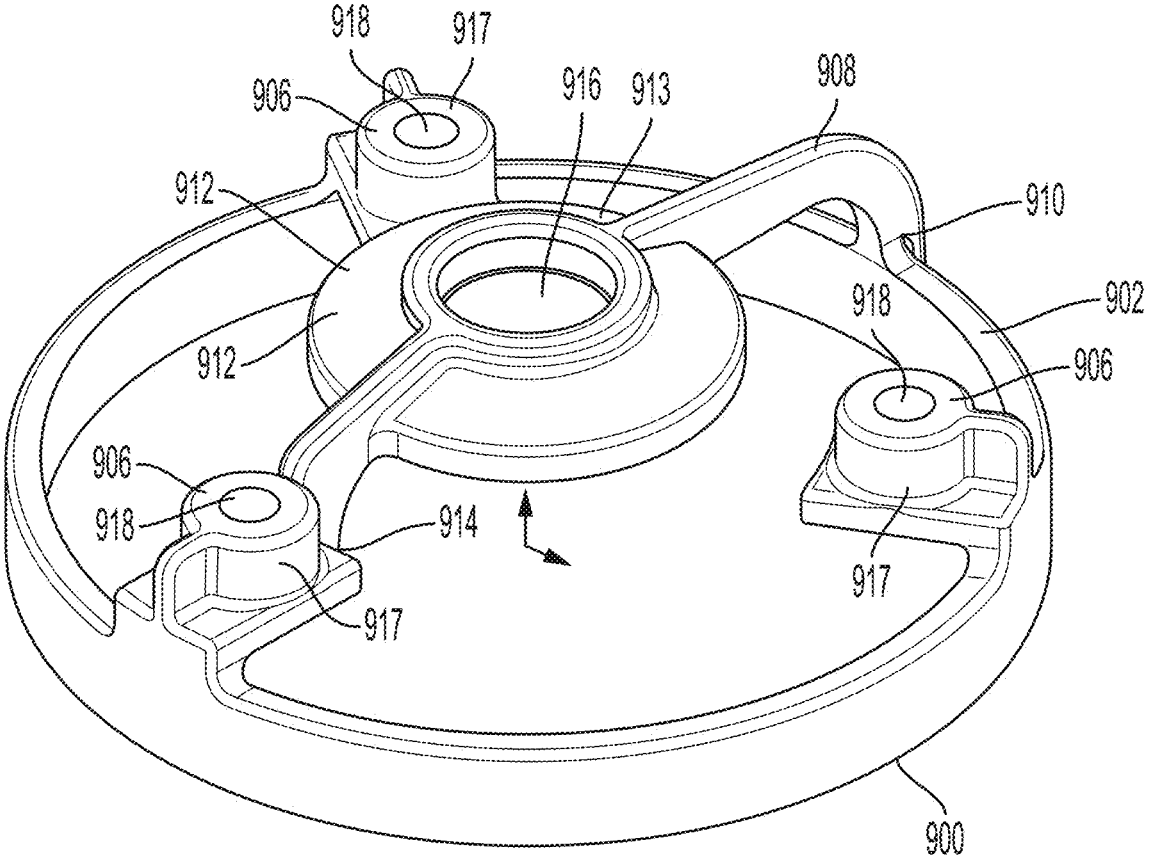
FIG. 9 is a front perspective view of a first embodiment of a cup holder according to the present disclosure.

Referring to FIG. 9, a first embodiment of cup holder 900 is shown. Cup holder 900 has an outer ring 902, support arm 908 and connectors 906. Outer ring 902 forms a circular shape. Support arm 908 has a first end 910, a cup holder hub 912, and a second end 914. First end 910 of support arm 908 is connected to outer ring 902. Cup holder hub 912 has a disk shape body 913. Cup holder hub 912 has a hole 916 through disk shape body 913. Connectors 906 are contacts that are configured to contact a cup 1000. Connectors 906 each have a connector body 917. Connectors 906 each have a hole 918 through connector body 917. Second end 914 of support arm 908 is connected to one of connectors 906 on an opposite side of outer ring 902 that is connected to first end 910.

Figure 10:
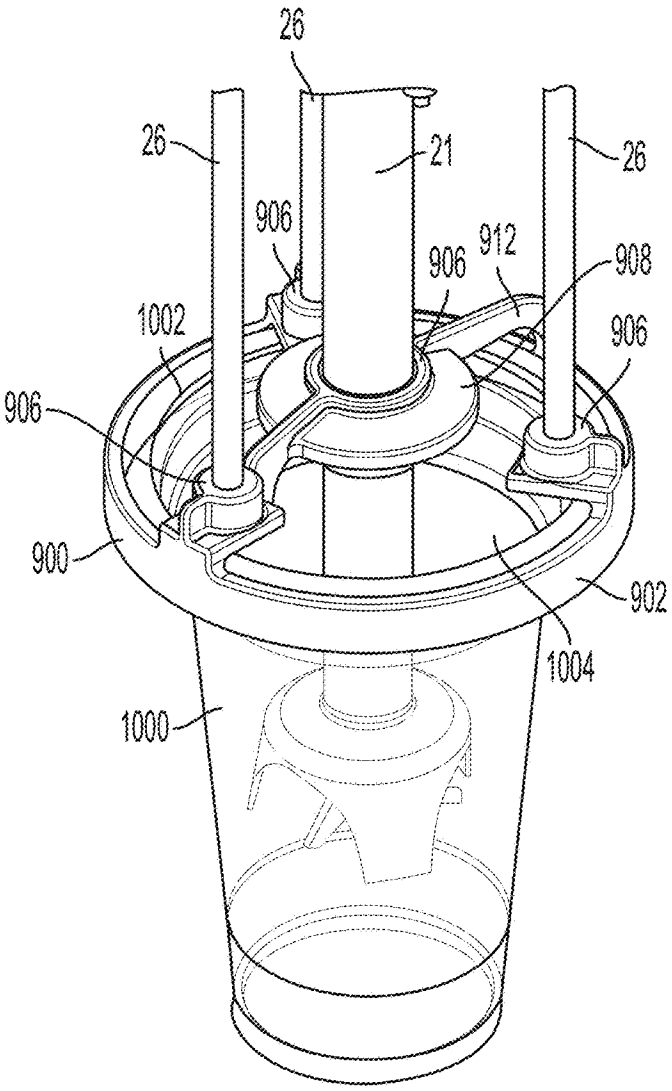
FIG. 10 is a partial front perspective view of the cup holder of FIG. 9 connected to cup holder guide rods and positioned on a cup with the cup having a portion of a mixer shaft with blade assembly therein.
Figure 15:
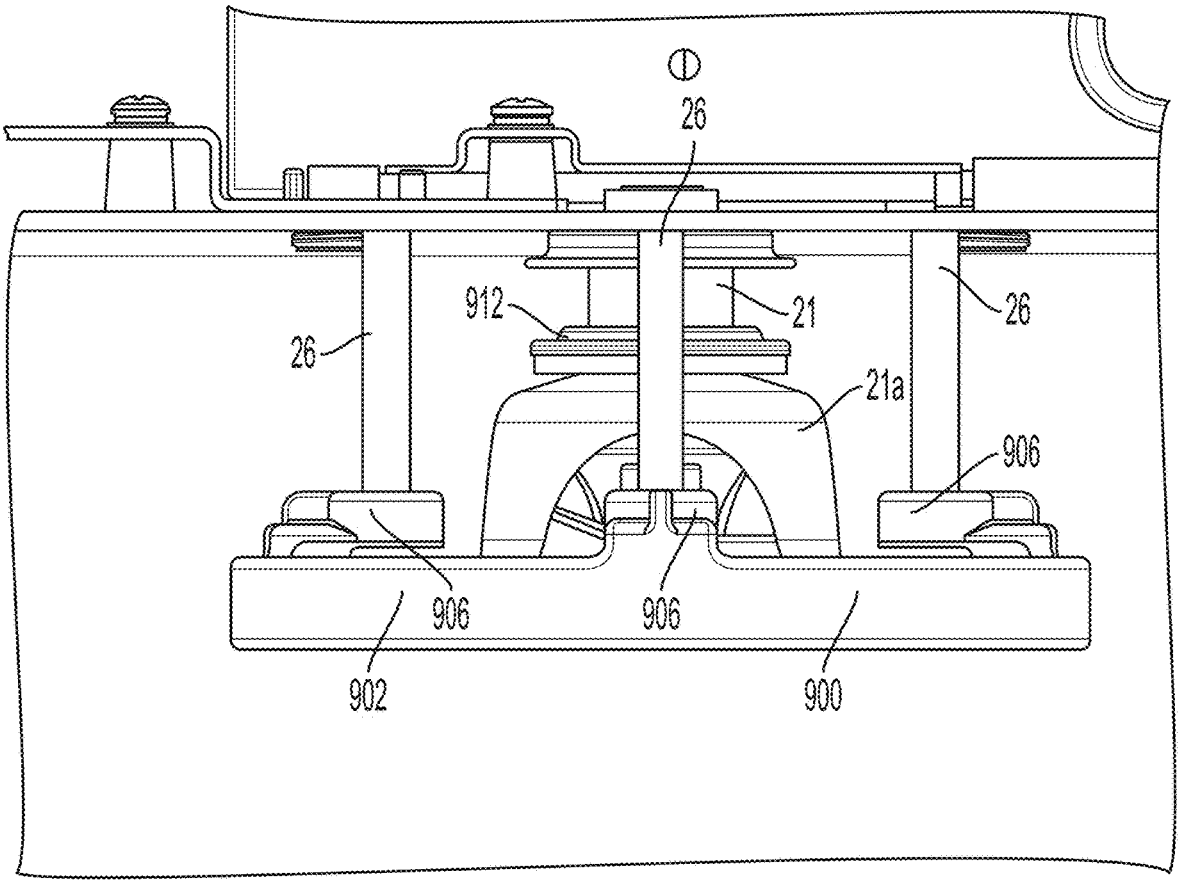
FIG. 15 is a partial front perspective view of the beverage blending machine of FIG. 3 having the cup holder of FIG. 9 connected to cup holder guide rods and having the portion of the mixer shaft with blade assembly therein.

Referring to FIG. 10, cup holder 900 is connected in cup holder assembly 24 by each of connectors 906 connecting to one of cup holder guide rods 26. Each of connectors 906 can connect to one of cup holder guide rods 26, as shown in FIG. 15, by, for example, screw threading on each of connectors 906 that mates with screw threading on each of cup holder guide rods 26, screw threads on cup holder guide rods 26 that each pass through one of holes 918 in connectors 906 and then receive a nut, snap fit or other fastener configurations. Mixer shaft with blade assembly 21 passes through hole 916 of cup holder hub 912. During operation, once connectors 906 of cup holder 900 contact a rim 1002 that surrounds an opening 1004 into cup 1000 and outer ring 902 moves below rim 1002 so that outer ring 902 provides structural rigidity to cup holder 900 but does not contact rim 1002, mixer shaft with blade assembly 21 can continue to move in cup 1000 while cup holder 900 is maintained in position applying a downward pressure on cup 1000 to minimize or prevent vertical, horizontal and rotational movement of cup 1000 during blending and/or mixing. The downward pressure can be applied between cup holder 900 and cup 1000 by springs 27 that connect one or more of cup holder guide rods 26 to mixer motor assembly with shaft and blade 19 so that the springs 27 stretch with movement of mixer shaft with blade assembly 21 into cup 1000 while cup holder 900 is maintained in position. Mixer motor 20 rotates the blade of mixer shaft with blade assembly 21 in cup 1000. After blending/mixing is complete, motor mount 22 and mixer motor mount bracket 23 move along linear rail actuator system 3 to move mixer shaft with blade assembly 21 and cup holder assembly 24 away from cup 1000 back to the initial position.

Figure 11:
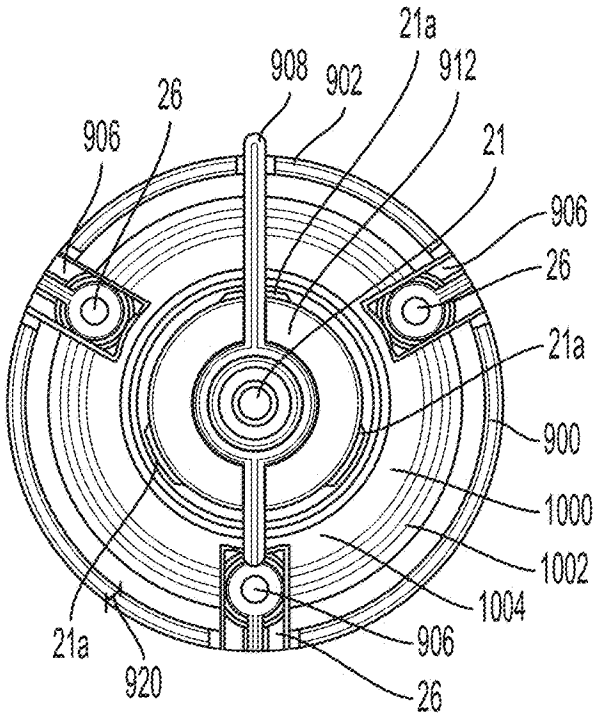
FIG. 11 is a top view of FIG. 10.

Referring to FIG. 11, mixer shaft with blade assembly 21 has bell housing 21*a* that extends outward therefrom. Bell housing 21*a* is sized so that cup holder hub 912 rests on bell housing 21*a* to move cup holder 900 prior to connectors 906 contacting rim 1002 of cup 1000 and cup holder hub 912 rests on bell housing 21*a* of mixer shaft with blade assembly 21 when cup holder 900 is moved away from cup 1000 back to the initial position after blending/mixing is complete. Once connectors 906 of cup holder 900 contact a rim 1002 of cup 1000, bell housing 21*a* moves with mixer shaft with blade assembly 21 into cup 1000 while cup holder 900 is maintained in position with connectors 906 contacting rim 1002. Outer ring 902 has a width 920, for example, in the range of 3 millimeters ("mm") to 5 mm. Outer ring 902 has a diameter that is greater than rim 1002, for example, 106 mm-127 mm. Outer ring 902 does not extend beyond blender/mixer/cleaner module 4, 104. Cup holder 900 is made of a plastic material, for example, ABS. Cup holder 900 has a weight of, for example, 41 grams.

Figure 35:
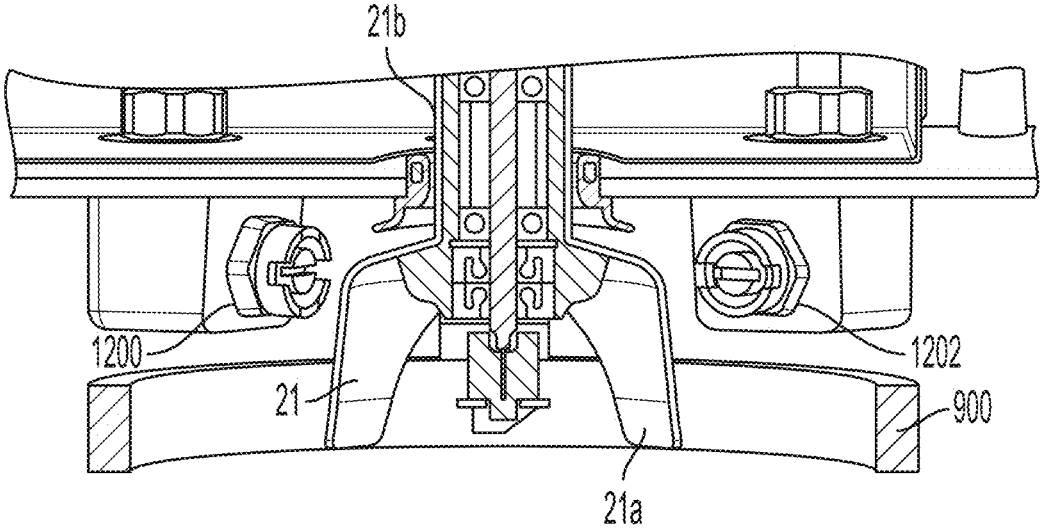
FIG. 35 is a partial view of the beverage blending machine of FIG. 3 having the cup holder of FIG. 16 having nozzles above the cup holder.

Referring to FIGS. 12 and 35, blender/mixer/cleaner module 4, 104 can be modified to have nozzles 1200, 1202. Nozzles 1200, 1202 are connected to a water source so that water can be supplied through nozzles 1200, 1202 during cleaning of cup holder 900. Cup holder 900 is cleaned from above cup holder 900 by nozzles 1200, 1202. Cup holder 900 is cleaned from above since cup holder 900 does not cover cup 1000 allowing ingredients to splash above cup holder 900. Nozzles 1200, 1202 can be positioned so that they are not oriented toward cup holder 900. Nozzles 1200, 1202 only need to rinse a top of a bell housing 21*a* and a blender shaft 21*b*. Nozzles 1200, 1202 can be angled downward so that they do not contact cup holder 900.

Blend in cup systems, BIC 1 and Assembly 100, generally require a method of preventing the cup from rotating excessively or from lifting upwards during the blending process. This allows for relative motion between the contents to be mixed and blending mechanism, as well as prevents the mixture from coming out of the holding vessel. A simple, but effective method for accomplishing this is to apply continuous downward pressure on the cup during blending/mixing. This can be done by cup holder 900, that can move vertically with the blender mechanism, mixer shaft with blade assembly 21, initially, but then independently, with at least 1 degree of freedom, when the blending mechanism enters the vessel, cup 1000, with the mixture to be blended. Traditional cup holders have generally been designed with equal or more surface area compared to the opening of the vessel. During the normal blending/mixing process small amounts of the mixture can contact these surfaces on the underside of cup holder 900. These surfaces then require cleaning to prevent potentially hazardous microbial growth as well as prevent cross-contamination between drink types. The amount of cleaning fluid (water) required to rinse these surfaces is directly proportional to the surface area of cup holder 900. Therefore, limiting the surface area of cup holder 900 that the mixture in the vessel can contact during the blending process reduces the opportunity for microbial growth, reduces the opportunity for cross contamination and reduces the amount of water required to completely rinse cup holder 900.

Blend in cup systems, BIC 1 and Assembly 100, introduce the blending mechanism, mixer shaft with blade assembly 21, to the top of the vessel, cup 1000, and traverse the blending mechanism vertically to the bottom while traditional blenders have a fixed blending mechanism in the bottom of the vessel that must move the mixture accordingly to be able to create homogenous mixture during the process. Both methods have advantages and disadvantages. Processing the mixture at the bottom of the vessel reduces the relative velocity between the mixture at the top of the vessel and the surrounding air. This reduces the heat transferred and therefore produces an overall colder beverage. Also, blending the drink from the bottom reduces the opportunity for any flavorings at the top of the vessel from being flung from the vessel before they can be entrained into the mixture, which would reduce the overall flavor of the beverage. Therefore, blending at the bottom reduces the amount of initial flavoring necessary to produce the desired flavor profile relative to drink processed starting from the top. A controller of BIC 1 and Assembly 100 have a mixing/blending profile for mixer shaft with blade assembly 21 that blends/mixes at a bottom of cup 1000 for a majority of the time of blending/mixing.

Figure 40:
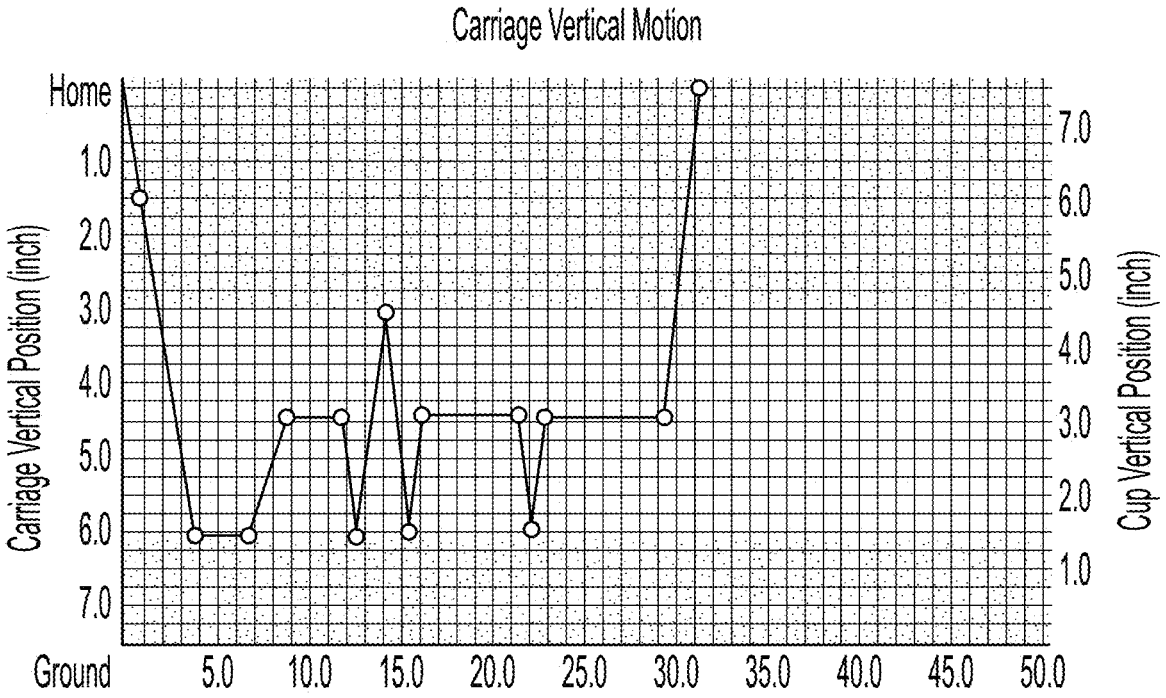
FIG. 40 is a graphical illustration of a first blending profile.

Referring to FIG. 40, a first blending profile is shown by a Table 1 and a Graph 1 that establishes a position of how far mixer shaft with blade assembly 21 is moved, a time that mixer shaft with blade assembly 21 is maintained in the position, and a speed that blades 21*c* of mixer shaft with blade assembly 21 is rotated while in the position. Mixer shaft with blade assembly 21 starts from an initial position. Mixer shaft with blade assembly 21 is moved downward from the initial position to a position 1.5 inches from the initial position between time 0 and 0.7 seconds, and, then, activated to rotate blades 21*c* at a speed of 100 percent of a maximum speed of rotation of blades 21*c* where the maximum speed of rotation of blades 21*c* is 13,500 revolutions per minute ("rpm"). Mixer shaft with blade assembly 21 is moved downward further to be 6.1 inches from the initial position during time 0.7 seconds to 3.7 seconds and maintained in this position until 6.7 seconds have elapsed. Thereafter, mixer shaft with blade assembly 21 is moved upward between time 6.7 seconds to 8.7 seconds to be 4.5 inches from the initial position and maintained in this position until 11.7 seconds have elapsed. Mixer shaft with blade assembly 21 is moved downward to be 6.1 inches from the initial position during time 11.7 seconds to 12.5 seconds and moved upward to be 3.1 inches from the initial position during time 12.5 seconds to 14.1. Mixer shaft with blade assembly 21 is moved downward to be 6.1 inches from the initial position during time 14.1 seconds to 15.3 seconds and then moved upward between time 15.3 seconds to 16.0 seconds to be 4.5 inches from the initial position and maintained in this position until 21.3 seconds have elapsed.

Mixer shaft with blade assembly 21 is then moved downward to be 6.0 inches from the initial position between time 21.3 seconds to 22.0 seconds and then moved upward between time 22.0 seconds to 22.7 seconds to be 4.5 inches from the initial position and is maintained in this position until after 29.3 seconds have elapsed when mixer shaft with blade assembly 21 is then stopped from rotating. Mixer shaft with blade assembly 21 is then moved back to the initial position between time 29.3 seconds to 31.3 seconds. Blades 21*c* of mixer shaft with blade assembly 21 rotate at a speed of 100 percent of the maximum speed of rotation of blades 21*c* once activated at all positions during the first blending profile prior to stopping. The position of 6.0 inches or greater is located in a bottom 1006 of cup 1000.

Figure 41:
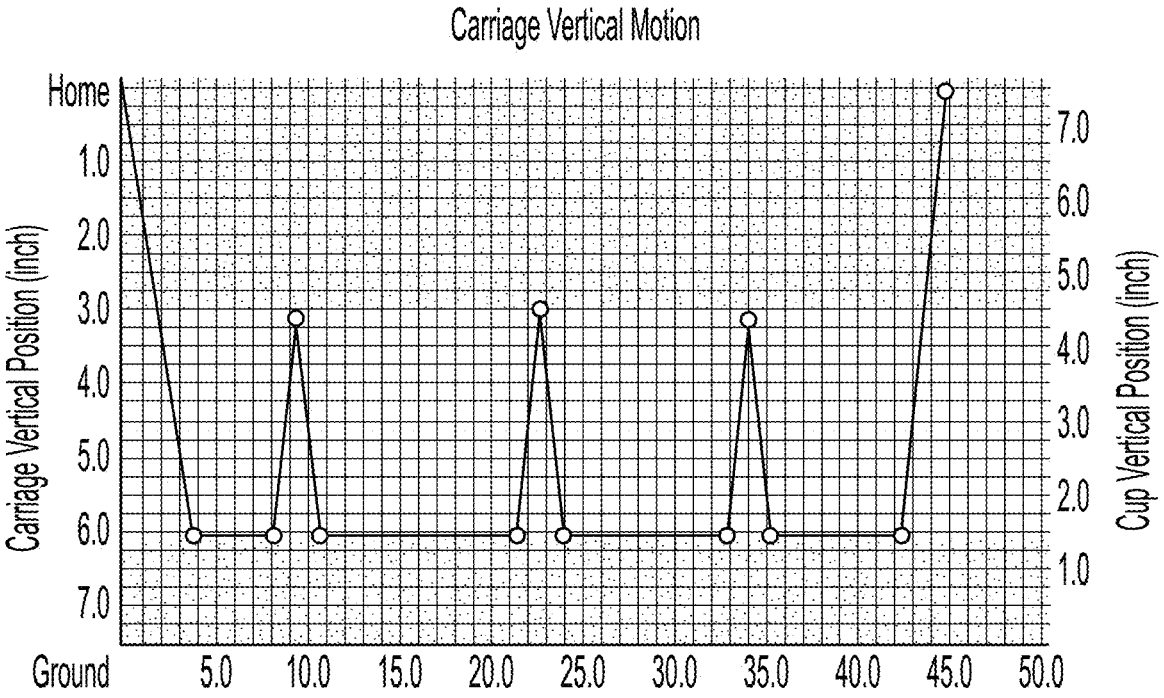
FIG. 41 is a graphical illustration of a second blending profile.

Referring to FIG. 41, a second blending profile is shown by a Table 2 and a Graph 2 that establishes a position of how far mixer shaft with blade assembly 21 is moved, a time that mixer shaft with blade assembly 21 is maintained in the position, and a speed that blades 21*c* of mixer shaft with blade assembly 21 is rotated while in the position. Mixer shaft with blade assembly 21 is moved downward from the initial position to a position 6.1 inches from the initial position between time 0 and 3.7 seconds and then activated to rotate at a speed of 50 percent of a maximum speed of rotation of blades 21*c* where the maximum speed of rotation of blades 21*c* is 13,500 rpm. Blades 21*c* are rotated at a speed of 75 percent of the maximum speed of rotation of blades 21*c* and is maintained in this position between time 3.7 seconds and 8.1 seconds. Mixer shaft with blade assembly 21 is then moved upward to be 3.1 inches from the initial position between time 8.1 and 9.3 seconds and moved back downward to be 6.1 inches from the initial position between time 9.3 and 10.6 seconds and rotation is increased to 100 percent of the maximum speed of rotation of blades 21*c* where this position is maintained until 21.4 seconds have elapsed and rotation is slowed to 75 percent of the maximum speed of rotation of blades 21*c*. Mixer shaft with blade assembly 21 is then moved upward to be 3.0 inches from the initial position between time 21.4 and 22.7 seconds and moved back downward to be 6.1 inches from the initial position between time 22.7 and 24.0 seconds and rotation is increased to 100 percent of the maximum speed of rotation of blades 21*c* while this position is maintained until 33.0 seconds have elapsed and rotation is slowed to 75 percent of the maximum speed of rotation of blades 21*c*. Mixer shaft with blade assembly 21 is then moved upward to be 3.1 inches from the initial position between time 33.0 and 34.2 seconds and moved back downward to be 6.1 inches from the initial position between time 34.2 and 35.4 seconds and rotation is increased to 100 percent of the maximum speed of rotation of blades 21*c* and is maintained in this position until 42.5 seconds have elapsed and rotation is stopped. Mixer shaft with blade assembly 21 is then moved back to the initial position between time 42.5 and 45.0 seconds. The position of 6.0 inches or greater is located in bottom 1006 of cup 1000.

Accordingly, the second profile of FIG. 41 has blades 21*c* that spend more time at a bottom of cup 1000, for example, when blades 21*c* are at 6.1 inches from the initial position, and reduces speed more than the first profile of FIG. 40. The second profile of FIG. 41 can be used with cup holder 900 or a cup holder that covers opening 1004 in cup 1000 completely; however, using the first profile of FIG. 40 with cup holder 900 contents of cup 1000 will probably spill out. The first profile of FIG. 40 and the second profile of FIG. 41 show that to blend with cup holder 900, it is desirable to avoid blending at top speed, for example, rotating blades 21*c* of mixer shaft with blade assembly 21 at 100 percent of the maximum speed of rotation of blades 21*c*, when blades 21*c* are not at the bottom of cup 1000. This is what prevents the contents of cup 1000 from overflowing or ejecting any of the contents through cup holder 900.

Creating a blended drink generally requires at least 3 steps. Putting the ingredients in the vessel, cup 1000, processing the ingredients and rinsing the processing mechanism. In this case, the mechanism includes mixer shaft with blade assembly 21 and cup holder 900. The amount of time it takes to complete cleaning of cup holder 900 depends on the surface area to be rinsed. Accordingly, the reduced surface area of cup holder 900 reduces rinse time and therefore reduces the overall drink process time. For example, a reduction in surface area underneath cup holder 900 can be reduced 80-95% by eliminating a top cover portion of the cup holder so that a majority or 80-95% of cup holder 900 is open. For example, 80-95% of cup holder 900 is open inside of outer ring 902.

For self-serve versions of blend in cup machines, for example, BIC 1 or Assembly 100, the theatre of watching the machine process the drink can be alluring to consumers and help to increase drinks sales for operators. Blend in cup systems where the cup holder has significant surface area can block the view of a consumer from watching their drink being processed. Therefore, the more of the drink processing that can be seen by the consumer the better. Cup holder 900 allows for the drink processing to be seen.

Accordingly, cup holder 900 minimizes surface area relative to opening 1004 in cup 1000. Cup holder 900 reduces surfaces to be cleaned to minimize water consumption, minimizes rinse time during cleaning, minimize opportunity for microbial growth, and minimize opportunity for cross contamination of products. Cup holder 900 enhances theatre by maximizing the transparency of the drink processing to the consumer. Blending profiles are specifically designed to process the drink in the bottom of cup 1000 when using cup holder 900. Drink quality is improved when using cup holder 900 by producing colder beverages and minimizing loss of flavor due to ejection from cup 1000.

Blend in cup machines, BIC 1 and Assembly 100, having cup holder 900 have precise control over the vertical position and speed of the blender mechanism throughout the blending cycle, precise control over the rotational speed of the blending motor throughout the blending cycle, minimize surface area of the cup holder 900 above cup 1000 while still serving the primary function of holding cup 1000 down and minimizing rotation of cup 1000 during the drink making process, and has a blender bell housing 21*a* to facilitate drink processing. Blender bell housing 21*a* creates a local zone of intense mixing while preventing the fluid above bell housing 21*a* from being agitated by the action of blades 21*c*. Without bell housing 21*b*, the fluid in cup 1000 all becomes agitated causing some of the fluid to be ejected from cup 1000.

Figure 14:
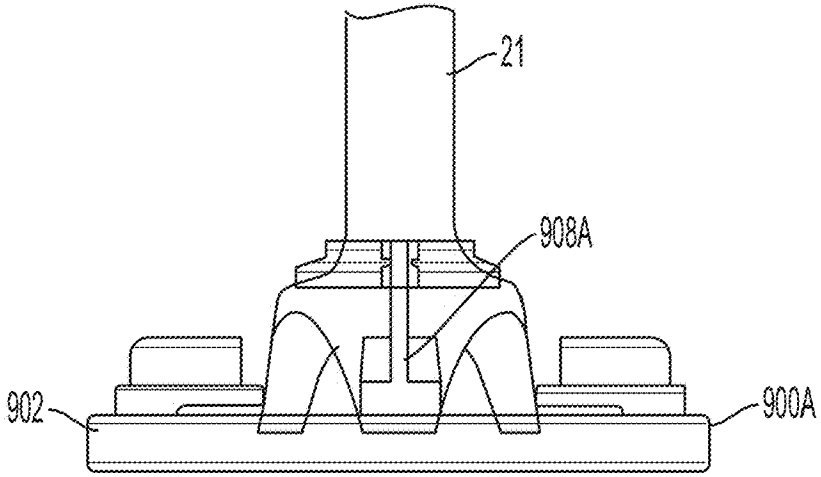
FIG. 14 is a partial enlarged side view of the cup holder of FIG. 9 that is modified on the mixer shaft with blade assembly of FIG. 10.
Figure 13:
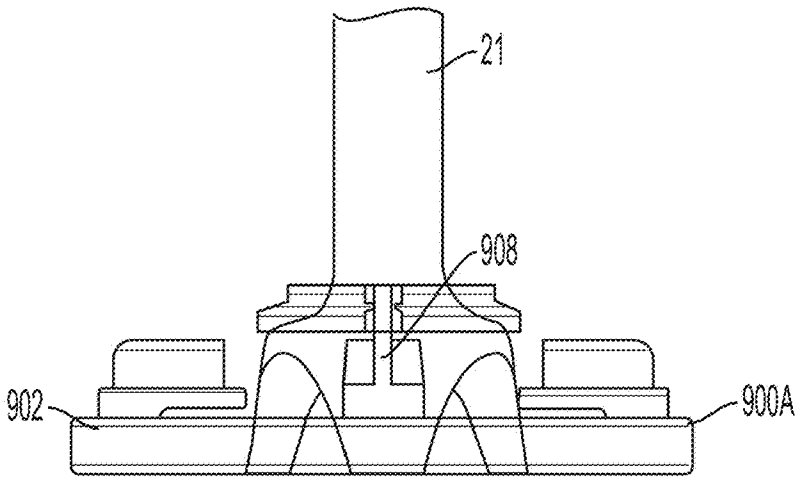
FIG. 13 is a partial enlarged side view of the cup holder of FIG. 9 on the mixer shaft with blade assembly of FIG. 10.

Referring to FIGS. 13 and 14, support arm 908 of cup holder 900 can be modified to a support arm 908A have a longer length as shown in FIG. 14 in a modified cup holder 900A. Cup holder 900A may be taller and weaker leading to needing to use a cup that has a smaller maximum height than a cup having a maximum height used with cup holder 900.

Figure 16:
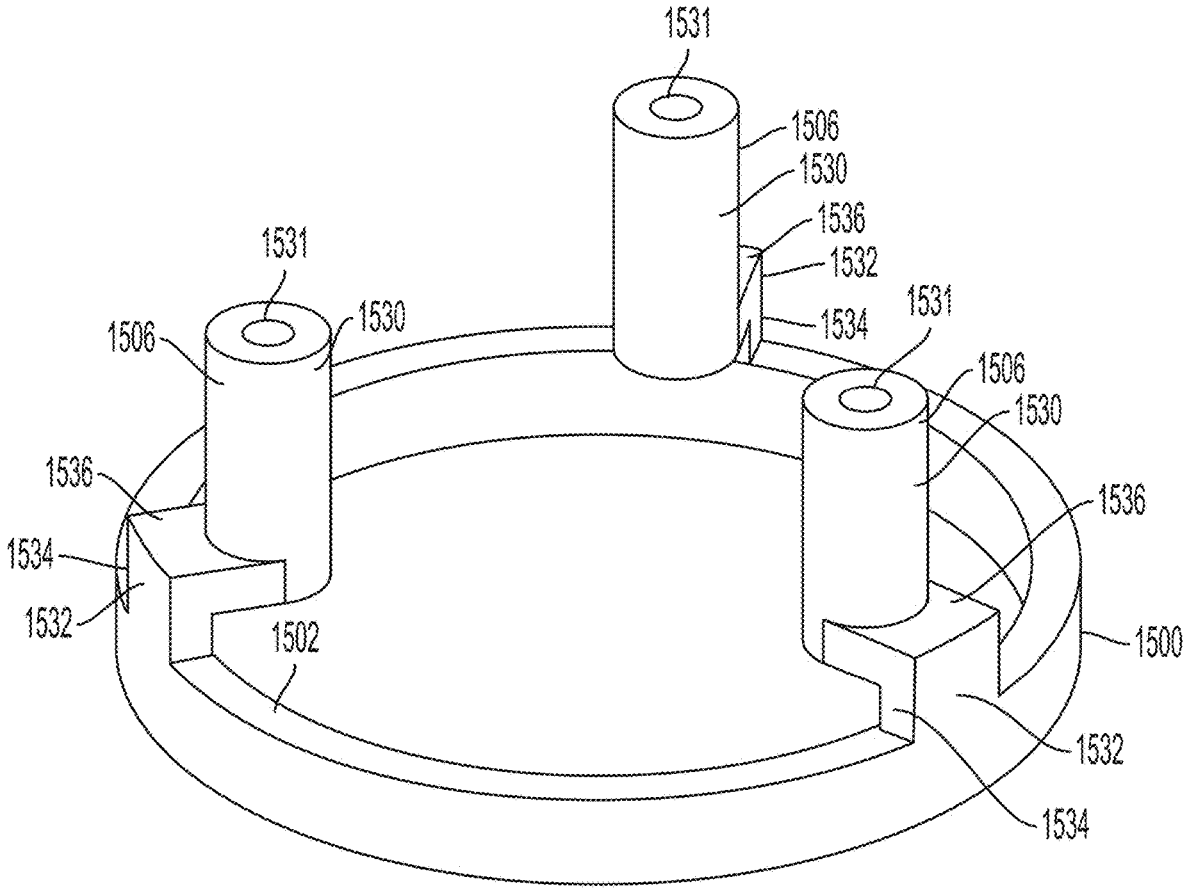
FIG. 16 is a front perspective view of another embodiment of a cup holder according to the present disclosure.
Figure 17:
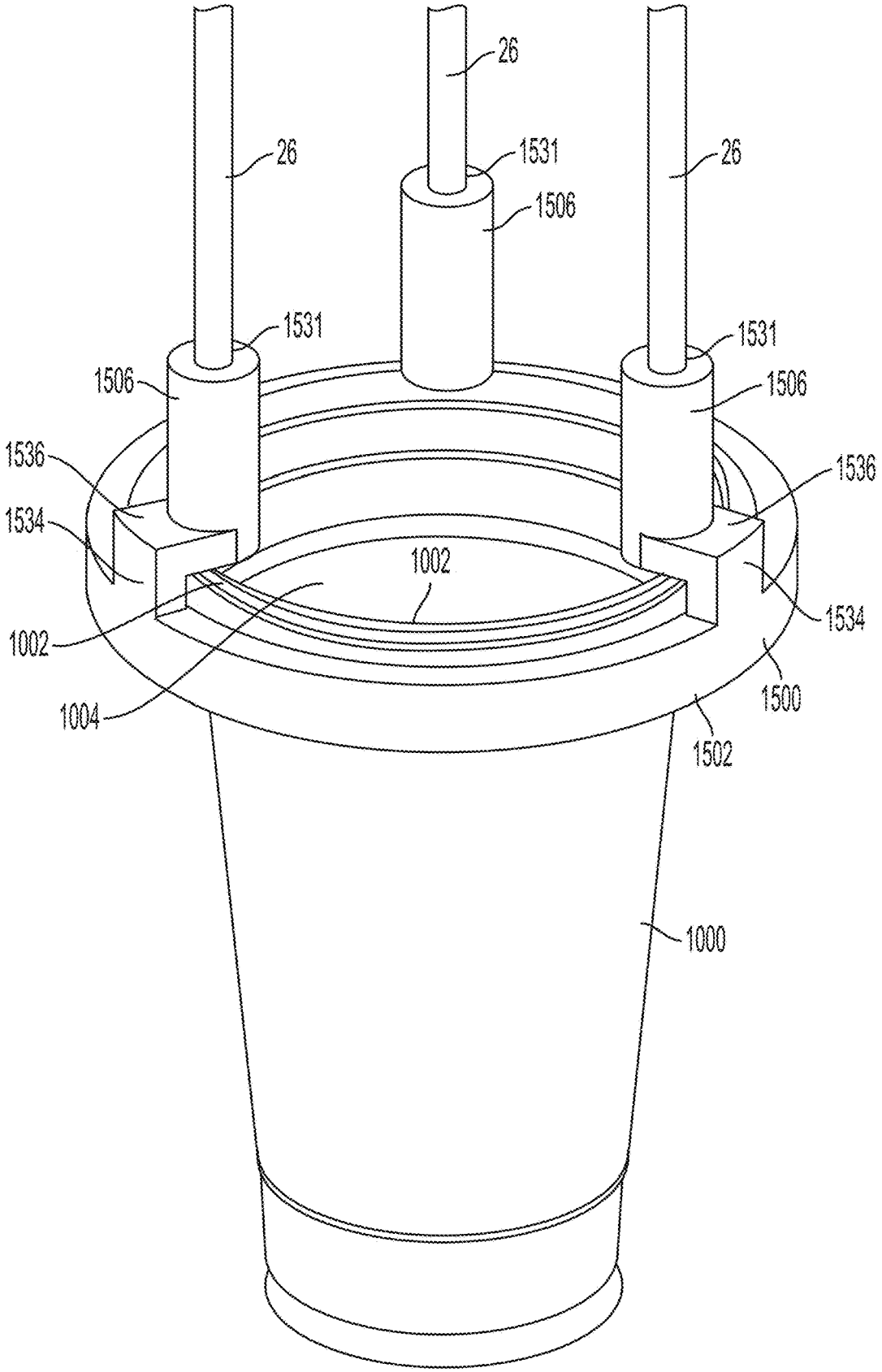
FIG. 17 is a partial front perspective view of the cup holder of FIG. 16 connected to cup holder guide rods and positioned on a cup.
Figure 18:
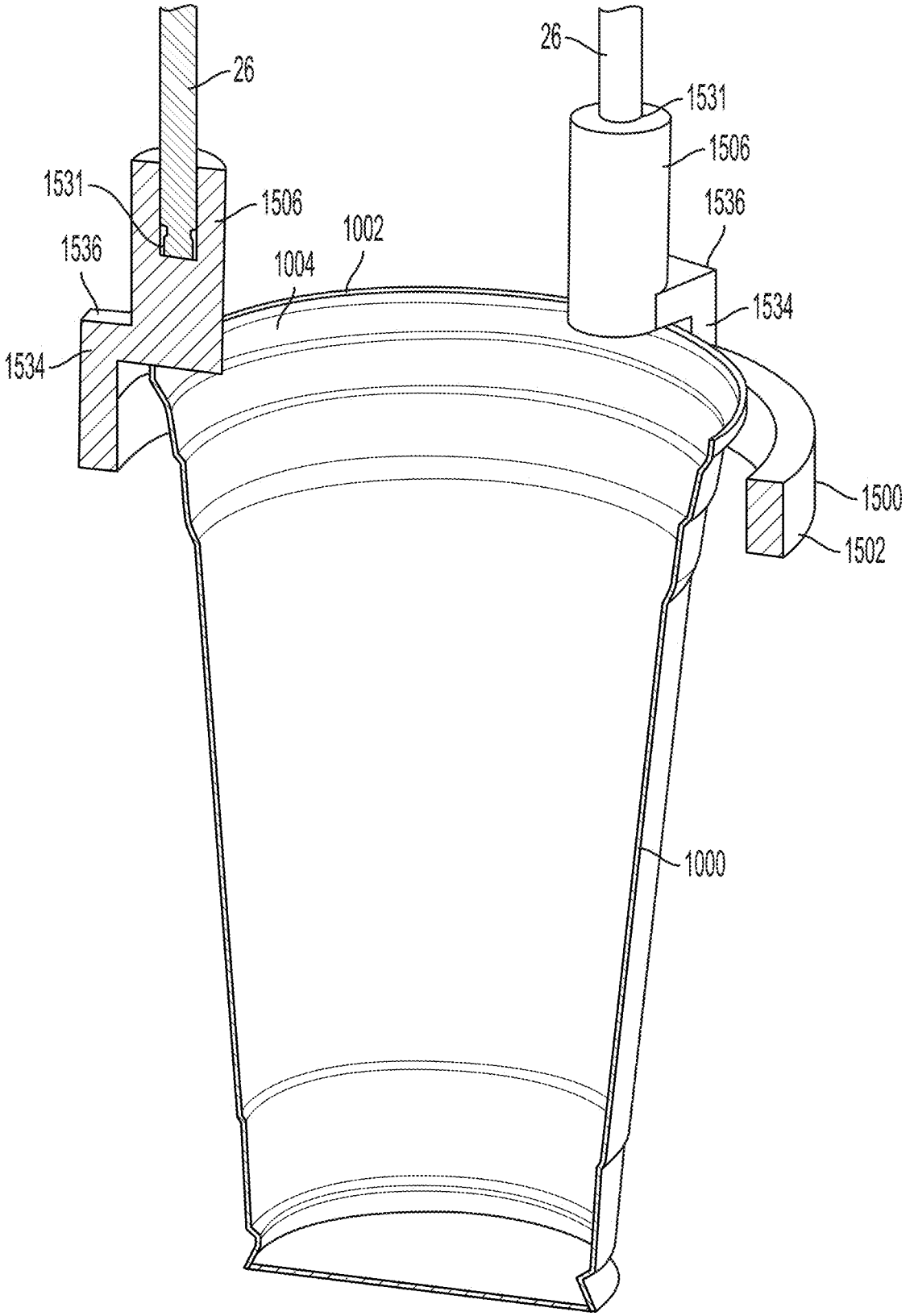
FIG. 18 is a front perspective cross-sectional view of FIG. 17.
Figure 19:
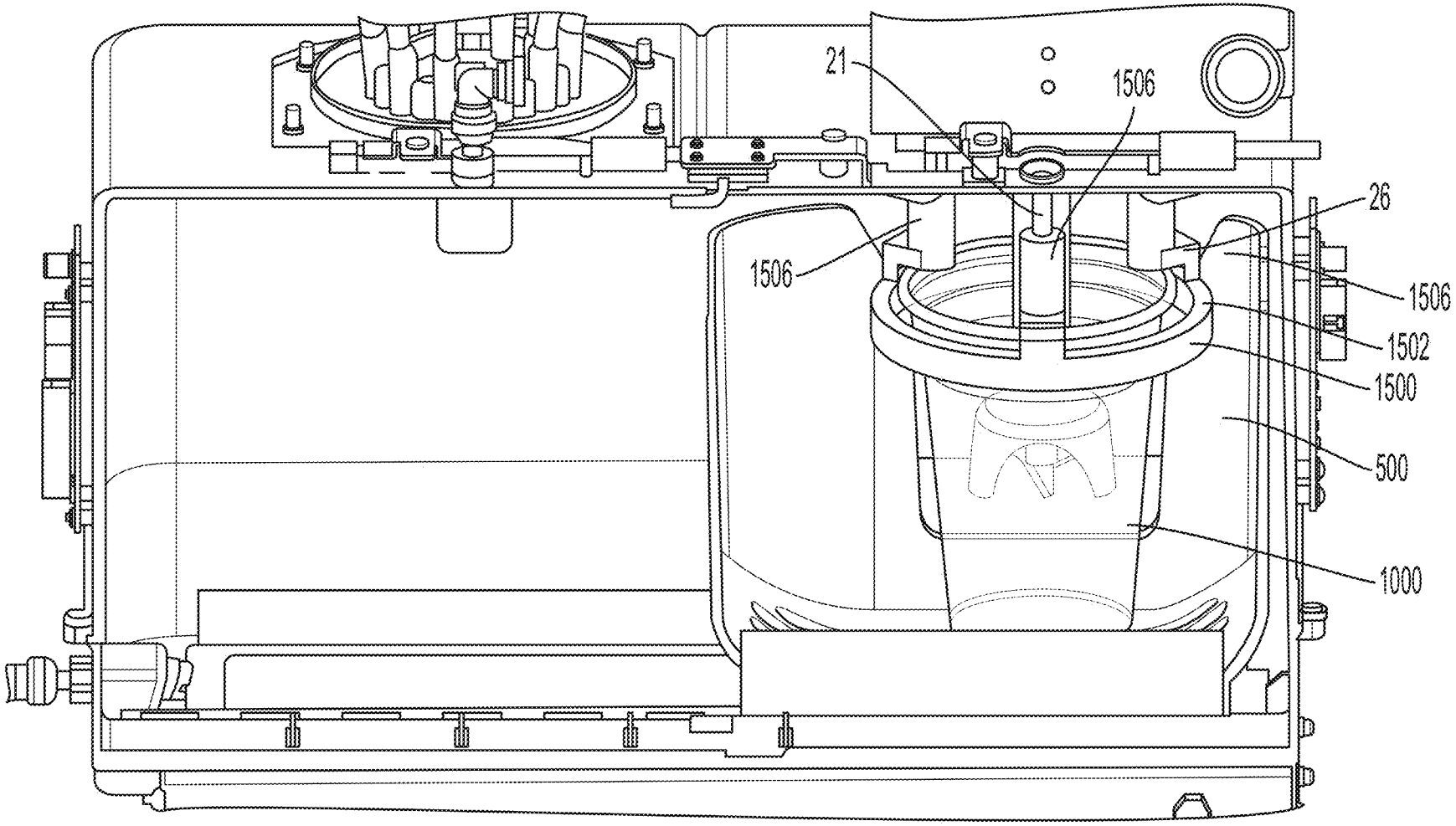
FIG. 19 is a partial front perspective view of the beverage blending machine of FIG. 3 having the cup holder of FIG. 16 connected to cup holder guide rods and positioned on the cup with the cup having the portion of the mixer shaft with blade assembly therein.
Figure 34:
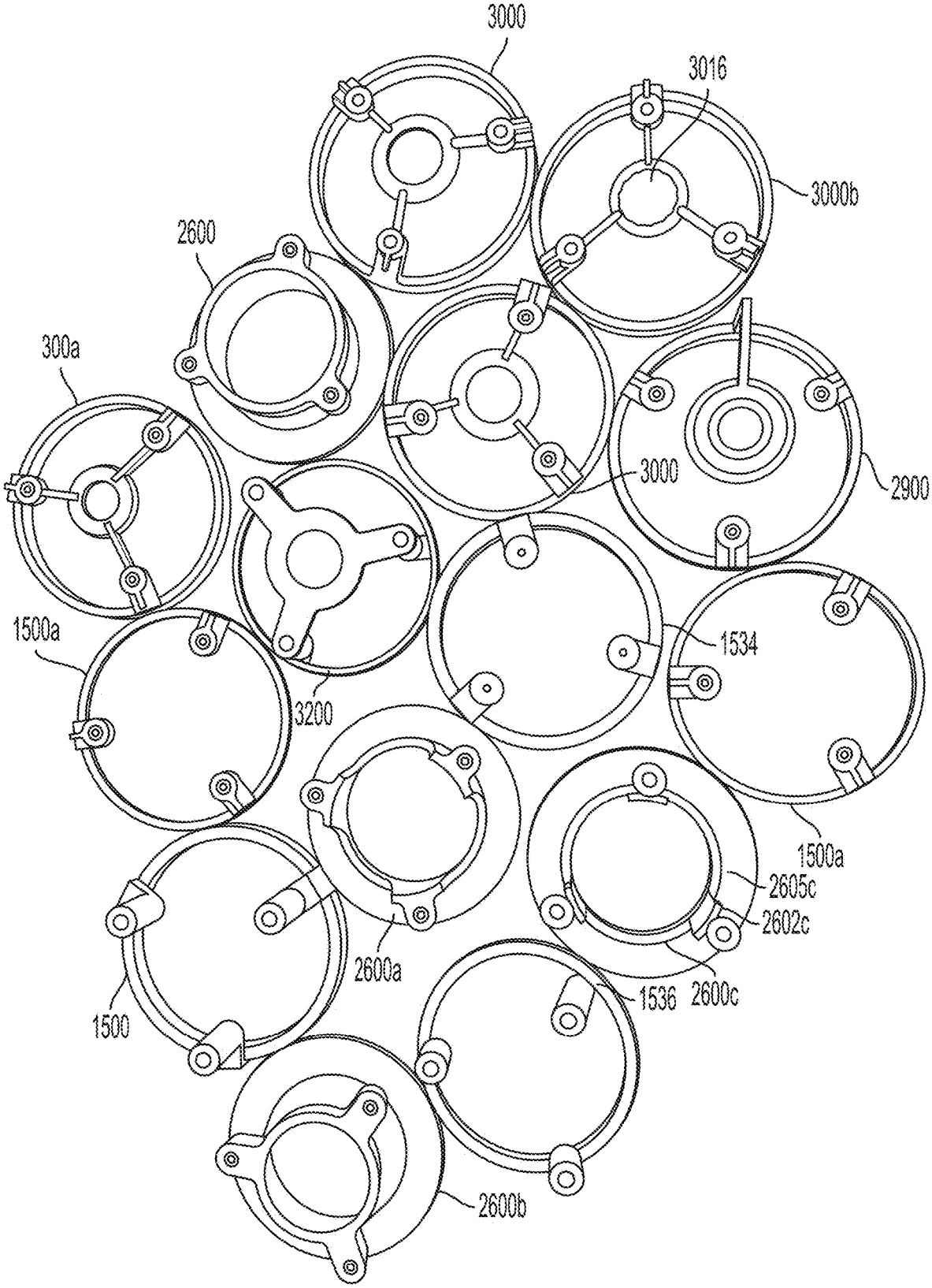
FIG. 34 is a top perspective view of embodiments of the cup holder according to the present disclosure.

Referring to FIGS. 16-19, a cup holder 1500 is shown. Cup holder 1500 is the same as cup holder 900 except cup holder 1500 does not include support arm 908 and has connectors 1506 that are shaped differently than connectors 906. Connectors 1506 each have a cylinder 1530 that is connected to an extender 1532. Each cylinder 1530 has a passage 1531 therethrough. Each extender 1532 has a vertical member 1534 and a horizontal member 1536. Horizontal member 1536 can be smaller as shown in FIG. 34. Outer ring 1502 is the same as outer ring 902. As shown in FIGS. 16-18, cup holder 1500 operates similar to cup holder 900 so that cup holder 1500 is connected in cup holder assembly 24 by each of connectors 1506 connecting to one of cup holder guide rods 26. Each of connectors 1506 connects to one of cup holder guide rods 26 by snap fit. Mixer shaft with blade assembly 21 passes through outer ring 1502 without contacting cup holder 1500. During operation, once connectors 1506 of cup holder 1500 contact rim 1002 that surrounds opening 1004 into cup 1000 and outer ring 1502 moves below rim 1002 so that outer ring 1502 provides structural rigidity to cup holder 1500 but does not contact rim 1002, mixer shaft with blade assembly 21 can continue to move in cup 1000 while cup holder 1500 is maintained in position applying a downward pressure on cup 1000 to minimize or prevent vertical, horizontal and rotational movement of cup 1000 during blending and/or mixing. Mixer motor 20 rotates the blade of mixer shaft with blade assembly 21 in cup 1000. After blending/mixing is complete, motor mount 22 and mixer motor mount bracket 23 move along linear rail actuator system 3 to move mixer shaft with blade assembly 21 and cup holder assembly 24 away from cup 1000 back to the initial position.

Figure 20:
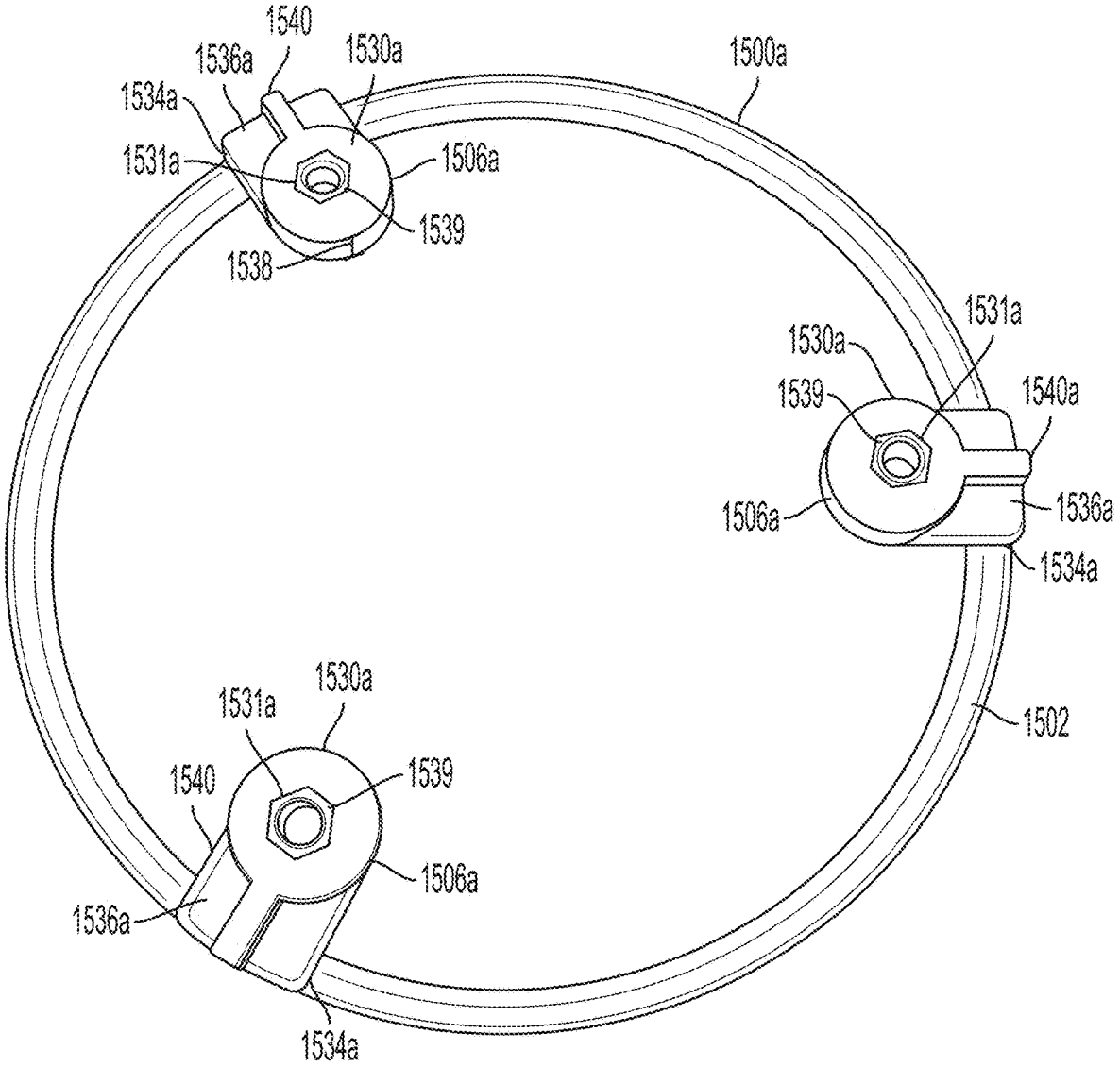
FIG. 20 is a top perspective view of the cup holder of FIG. 16 that is modified.

Referring to FIG. 20, cup holder 1500 can be modified as shown by cup holder 1500*a* so that each of cylinders 1530 have a shorter height 1538 and a support rib 1540 as shown by cylinders 1530*a*. Passage 1531 is modified to passage 1531*a* that has screw threads 1539. Each of connectors 1506*a* connects to one of cup holder guide rods 26 by mating screw threads on each of cup holder guide rods 26 and connectors 1506*a*. Vertical member 1534 and horizontal member 1536 can also be modified to have different dimensions as shown by vertical member 1534*a* and horizontal member 1536*a*. Operation of cup holder 1500*a* is the same as cup holder 1500.

Figure 21:
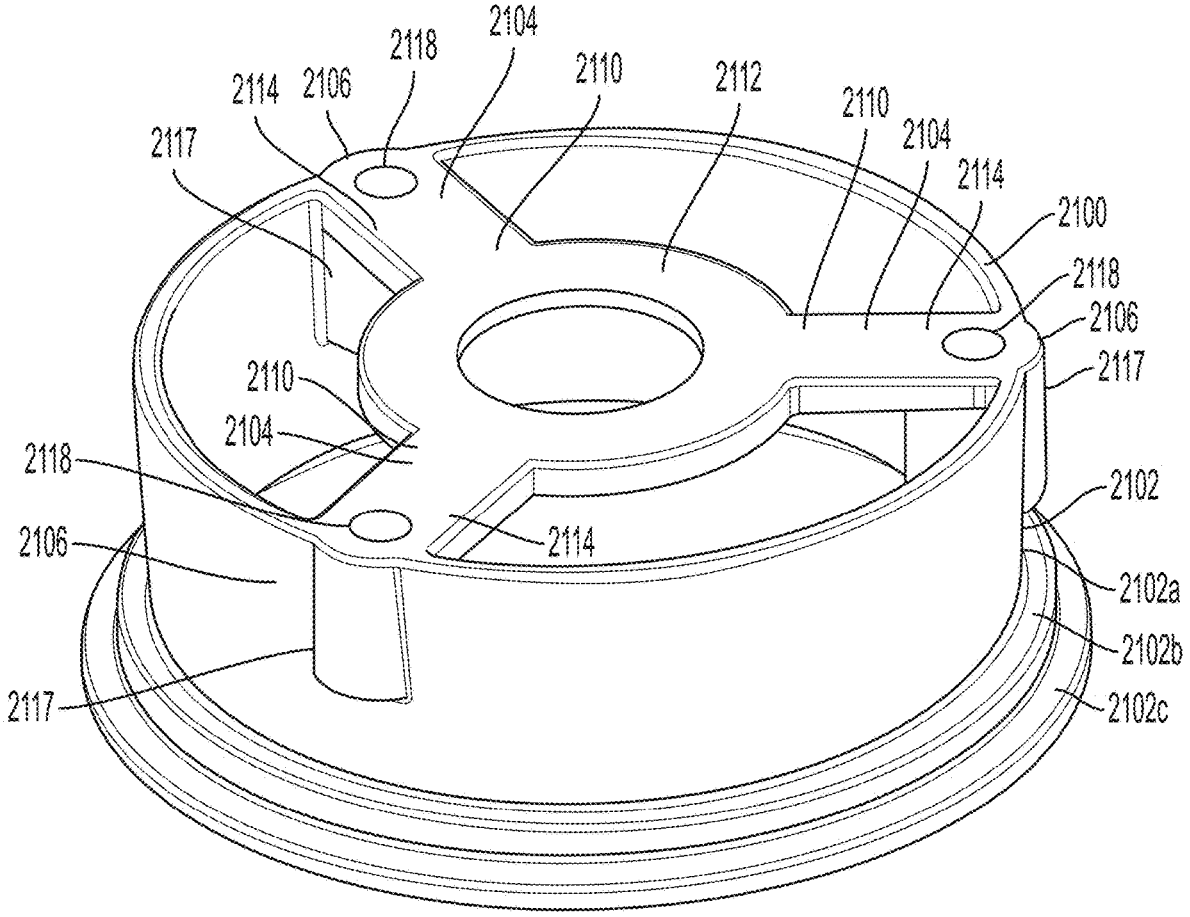
FIG. 21 is a front perspective view of another embodiment of a cup holder according to the present disclosure.
Figure 25:
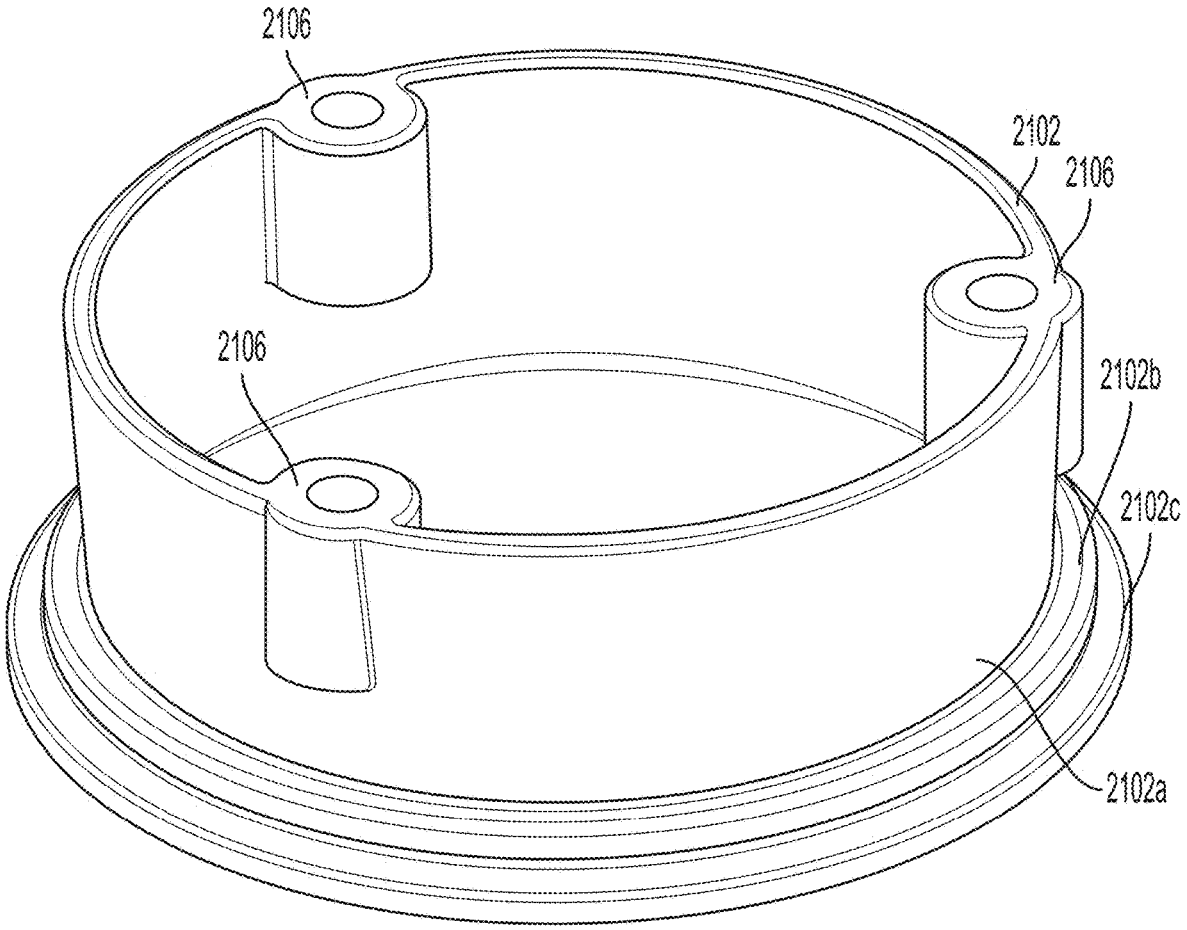
FIG. 25 is a top perspective view of the cup holder of FIG. 21 that is modified.

Referring to FIG. 21, another embodiment of cup holder 2100 is shown. Cup holder 2100 has an outer ring 2102, support arms 2104, connectors 2106 and a cup holder hub 2112. Outer ring 2102 has a first section 2102*a*, a second section 2102*b* and a third section 2102*c*. First section 2102*a* has a smaller diameter than second section 2102*b*. Second section 2102*b* has a smaller diameter than third section 2102*c*. Connectors 2106 each have a connector body 2117. Connectors 2106 each have a passage 2118 through connector body 2117. Each of supports arms 2104 has a first end 2110 and a second end 2114. First end 2110 is connected to cup holder hub 2112. Second end 2114 of each of support arms 2108 is connected to one of connectors 2106. Cup holder hub 912 has a disk shape body 2114. Cup holder hub 2112 has a hole 2116 through disk shape body 2114. Referring to FIG. 25, cup holder 2100 can be modified to omit support arms 2104 and a cup holder hub 2112.

Figure 22:
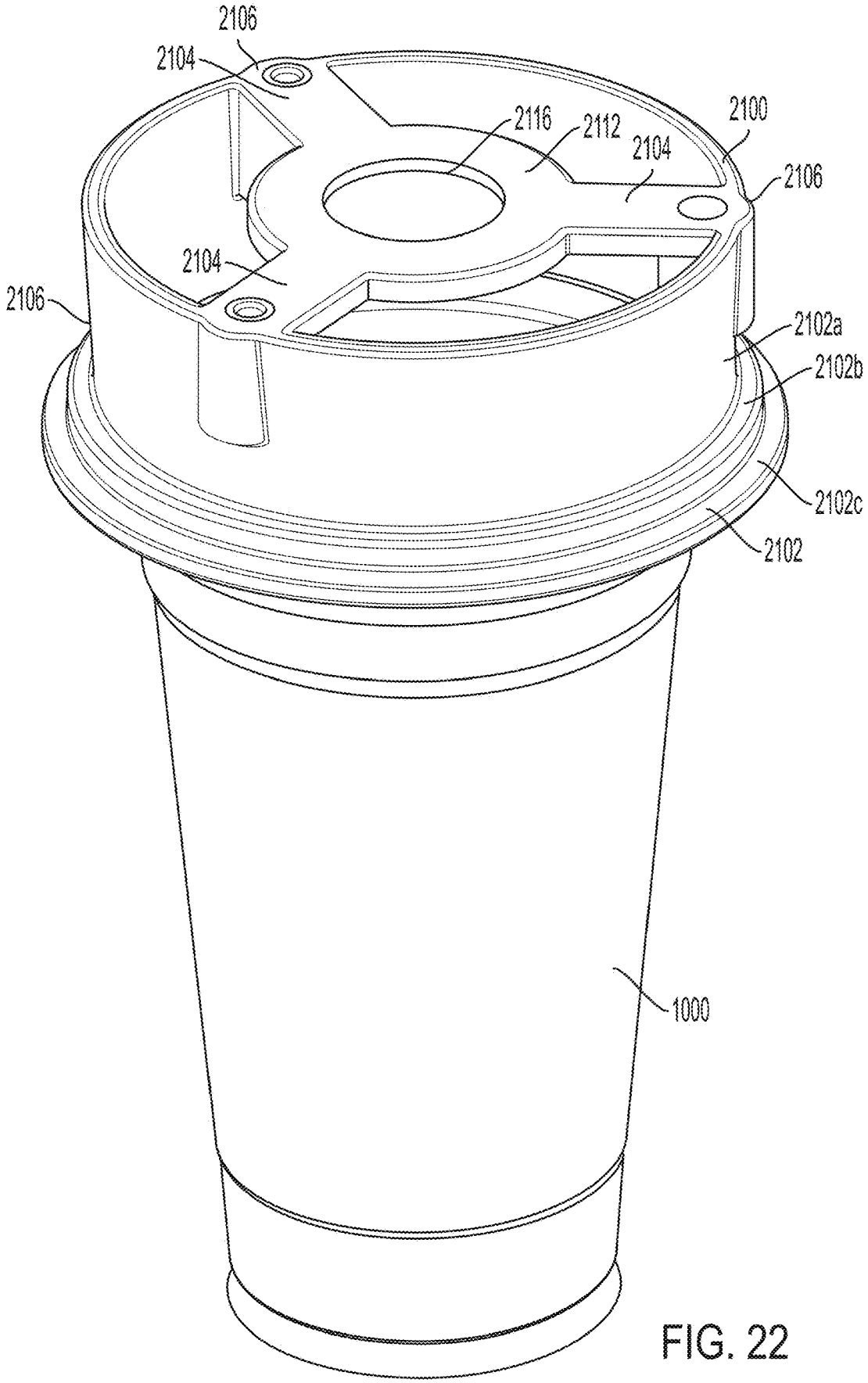
FIG. 22 is a front perspective view of the cup holder of FIG. 21 connected to a cup.
Figure 23:
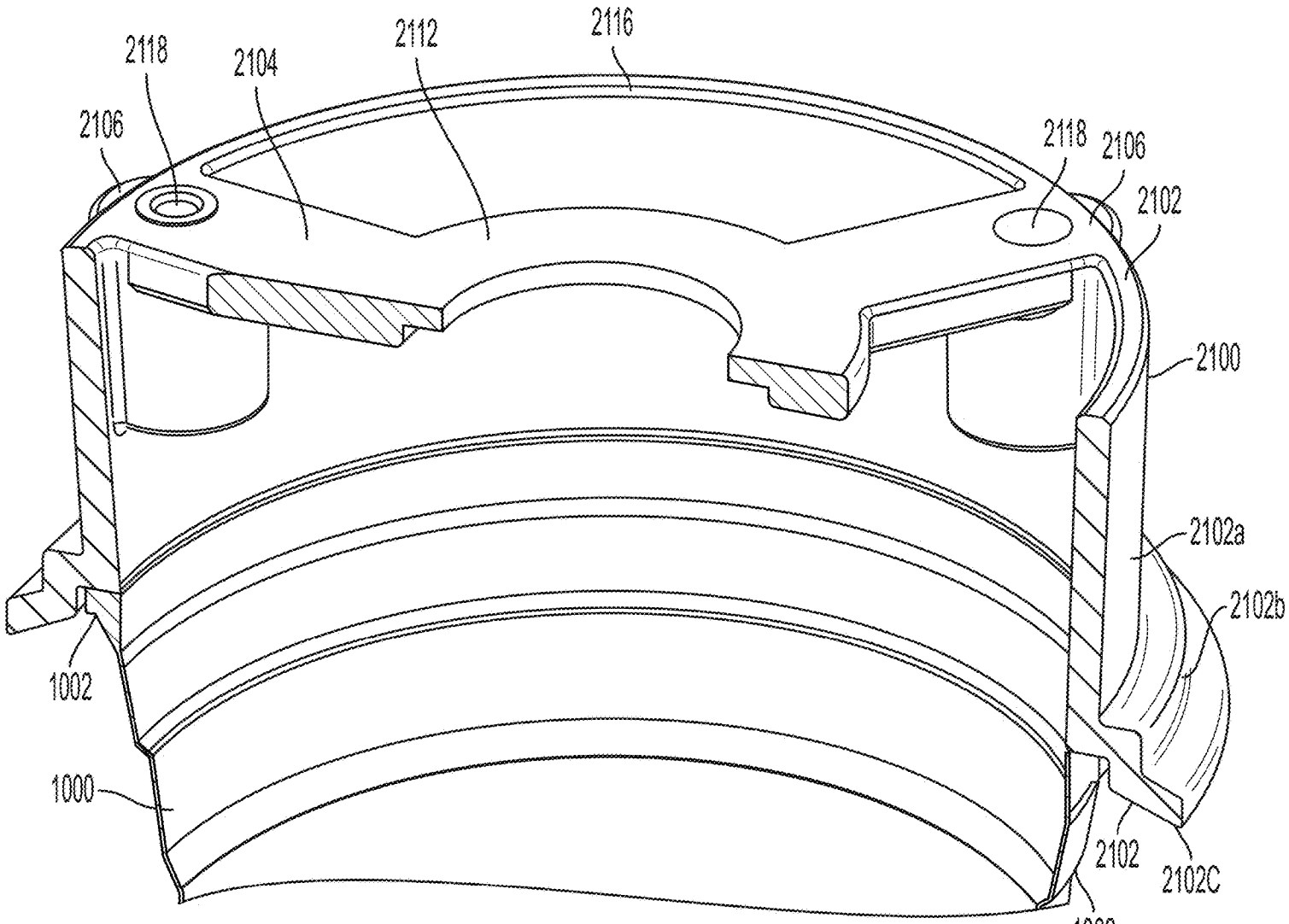
FIG. 23 is a partial front perspective cross-sectional view of FIG. 22.
Figure 24:
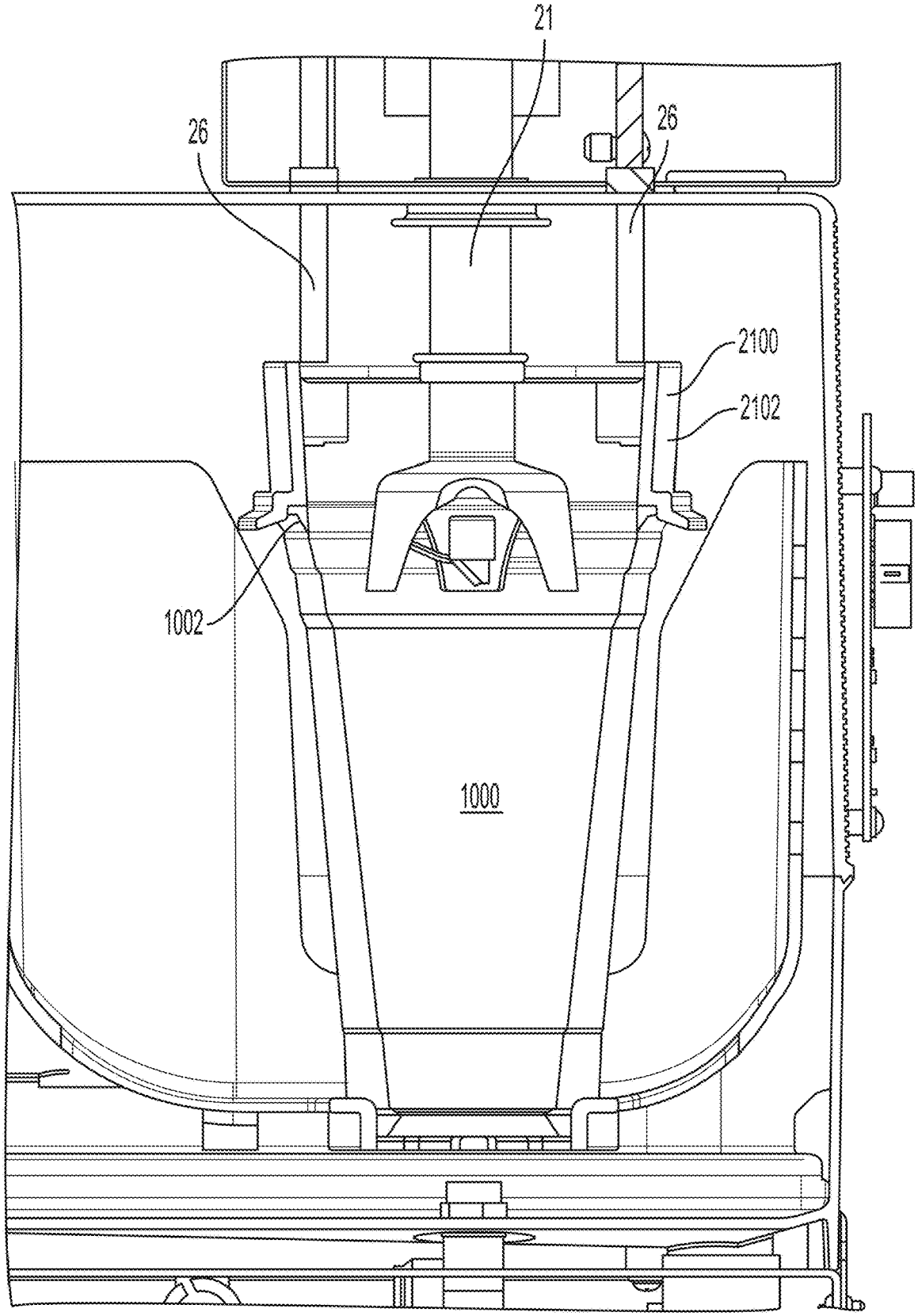
FIG. 24 is a partial front perspective view of the beverage blending machine of FIG. 3 having the cup holder of FIG. 21, shown in cross-section, connected to a cup, shown in cross-section, and the cup holder guide rods and having the portion of the mixer shaft with blade assembly therein.

Referring to FIGS. 22-24, cup holder 2100 is connected in cup holder assembly 24 by each of connectors 2106 connecting to one of cup holder guide rods 26. Each of connectors 2106 can connect to one of cup holder guide rods 26 by, for example, screw threading on each of connectors 2106 that mates with screw threading on each of cup holder guide rods 26, screw threads on cup holder guide rods 26 that each pass through one of holes 2118 in connectors 2106 and then receive a nut, snap fit or other fastener configurations. Mixer shaft with blade assembly 21 passes through hole 2116 of cup holder hub 2112. During operation, once first section 2102*a*, second section 2102*b*, and/or third section 2102*c* of outer ring 2102, depending on a size of cup 1000, contact rim 1002 that surrounds opening 1004 into of cup 1000, mixer shaft with blade assembly 21 can continue to move in cup 1000 while cup holder 2100 is maintained in position applying a downward pressure on cup 1000 to minimize or prevent vertical, horizontal and rotational movement of cup 1000 during blending and/or mixing. Mixer motor 20 rotates the blade of mixer shaft with blade assembly 21 in cup 1000. After blending/mixing is complete, motor mount 22 and mixer motor mount bracket 23 move along linear rail actuator system 3 to move mixer shaft with blade assembly 21 and cup holder assembly 24 away from cup 1000 back to the initial position.

Figure 26:
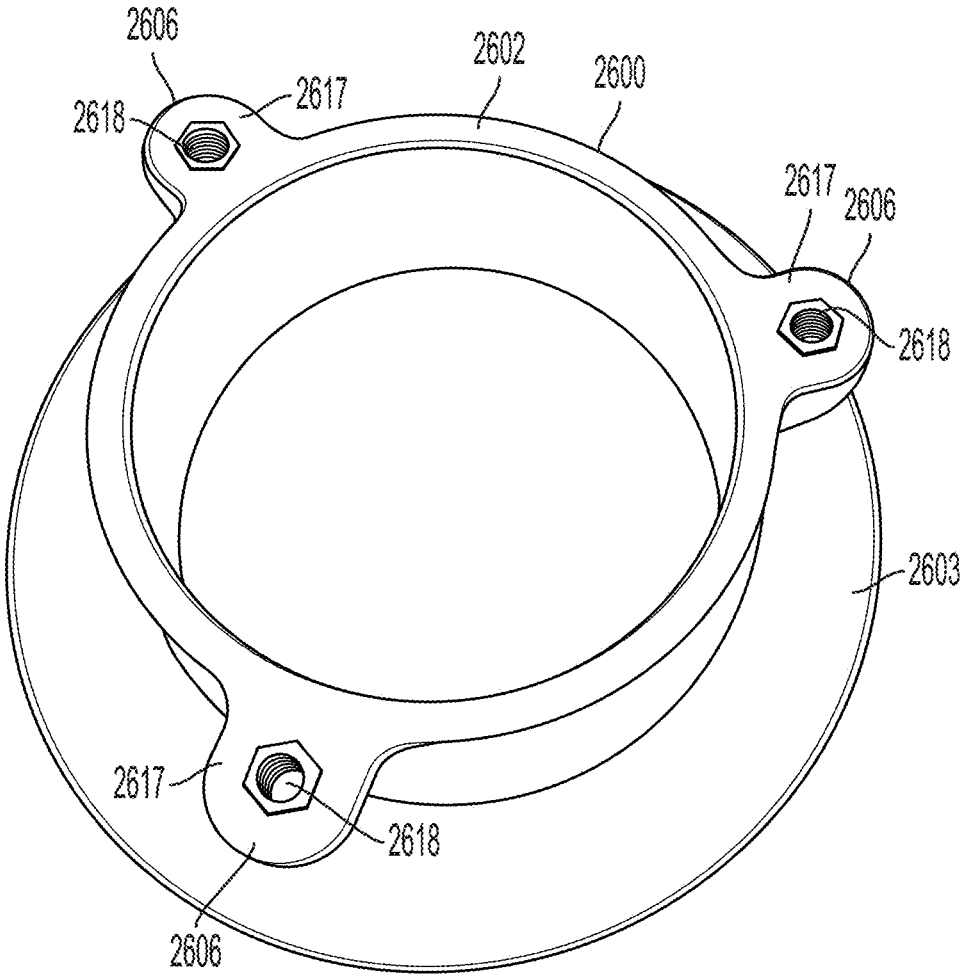
FIG. 26 is a front perspective view of another embodiment of a cup holder according to the present disclosure.
Figure 27:
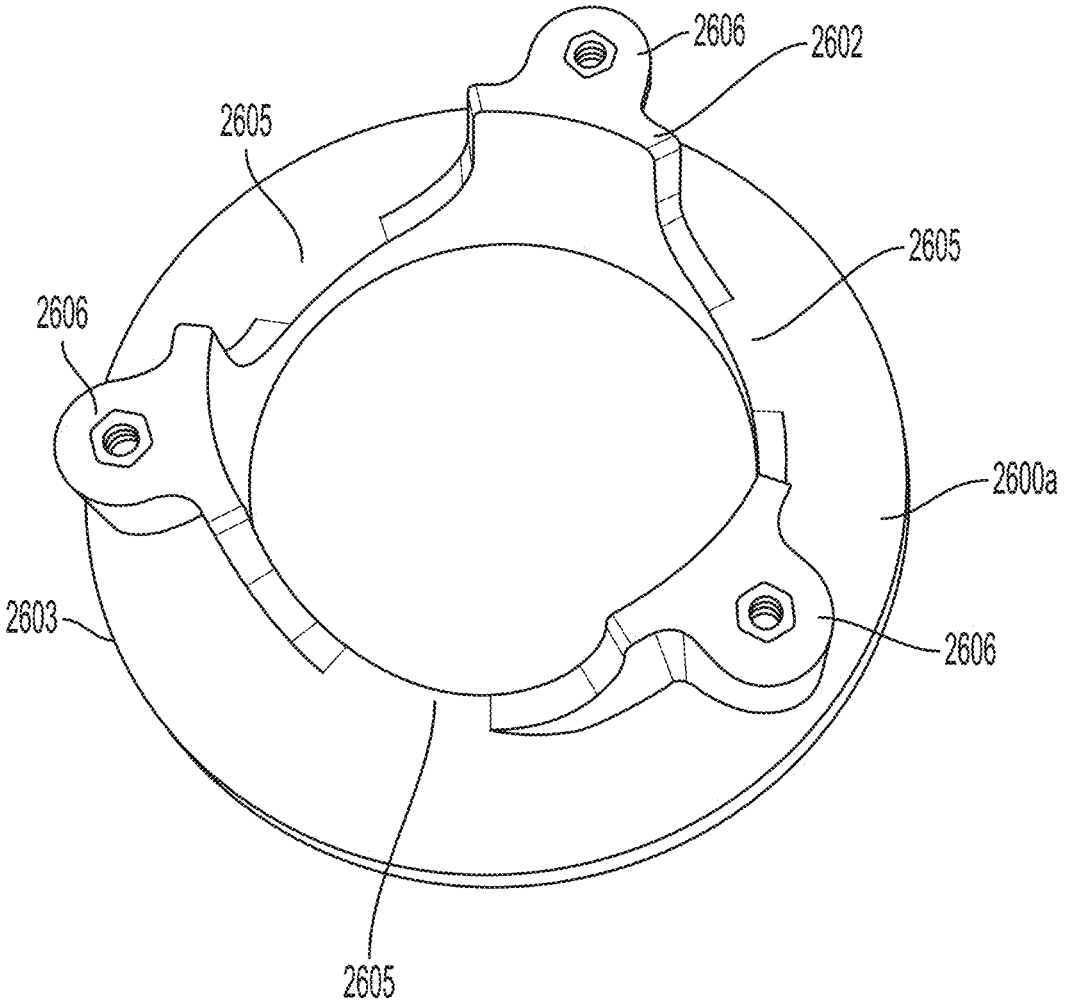
FIG. 27 is a top perspective view of the cup holder of FIG. 26 that is modified.
Figure 28:
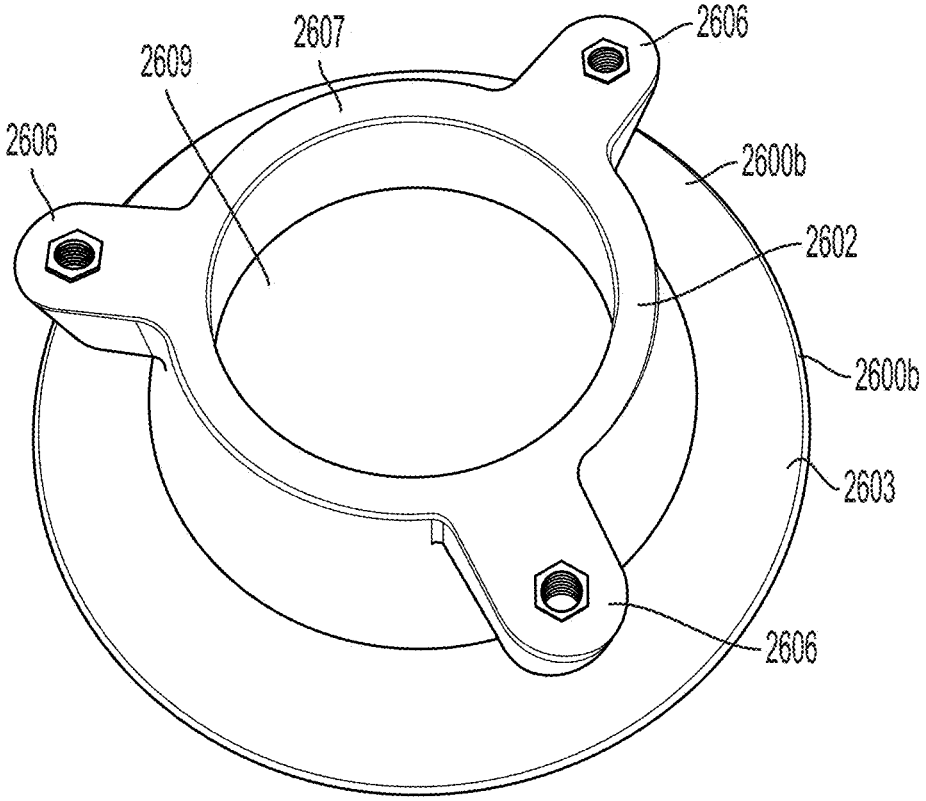
FIG. 28 is a top perspective view of the cup holder of FIG. 26 that is modified.

Referring to FIG. 26, another embodiment of cup holder 2600 is shown. Cup holder 2600 has an outer ring 2602 and connectors 2606. Outer ring 2602 is connected to an outer rim 2603 that extends outward from outer ring 2602. Connectors 2606 each have a connector body 2617 that extends outward from outer ring 2602. Connectors 2606 each have a passage 2618 through connector body 2617. Referring to FIG. 27, cup holder 2600 can be modified to cup holder 2600*a* so that outer ring 2602 has cutouts 2605. Referring to FIG. 28, cup holder 2600 can be modified to cup holder 2600*b* so that outer ring 2602 has a tapered shape that tapers upward from outer rim 2603 forming a top opening 2607 having a smaller diameter than an opening 2609 through outer rim 2603. Referring to FIG. 34, cup holder 2600 can be modified to cup holder 2600*c* so that outer ring 2602*c* has larger cutouts 2605*c* than cutouts 2605 of FIG. 27.

Cup holder 2600 is connected in cup holder assembly 24 by each of connectors 2606 connecting to one of cup holder guide rods 26. Each of connectors 2606 can connect to one of cup holder guide rods 26 by, for example, screw threading on each of connectors 2606 that mates with screw threading on each of cup holder guide rods 26, screw threads on cup holder guide rods 26 that each pass through one of holes 2618 in connectors 2606 and then receive a nut, snap fit or other fastener configurations. Mixer shaft with blade assembly 21 passes through outer ring 2602. During operation, once outer rim 2603 contact rim 1002 that surrounds opening 1004 into of cup 1000, mixer shaft with blade assembly 21 can continue to move in cup 1000 while cup holder 2600 is maintained in position applying a downward pressure on cup 1000 to minimize or prevent vertical, horizontal and rotational movement of cup 1000 during blending and/or mixing. Mixer motor 20 rotates the blade of mixer shaft with blade assembly 21 in cup 1000. After blending/mixing is complete, motor mount 22 and mixer motor mount bracket 23 move along linear rail actuator system 3 to move mixer shaft with blade assembly 21 and cup holder assembly 24 away from cup 1000 back to the initial position.

Figure 29:
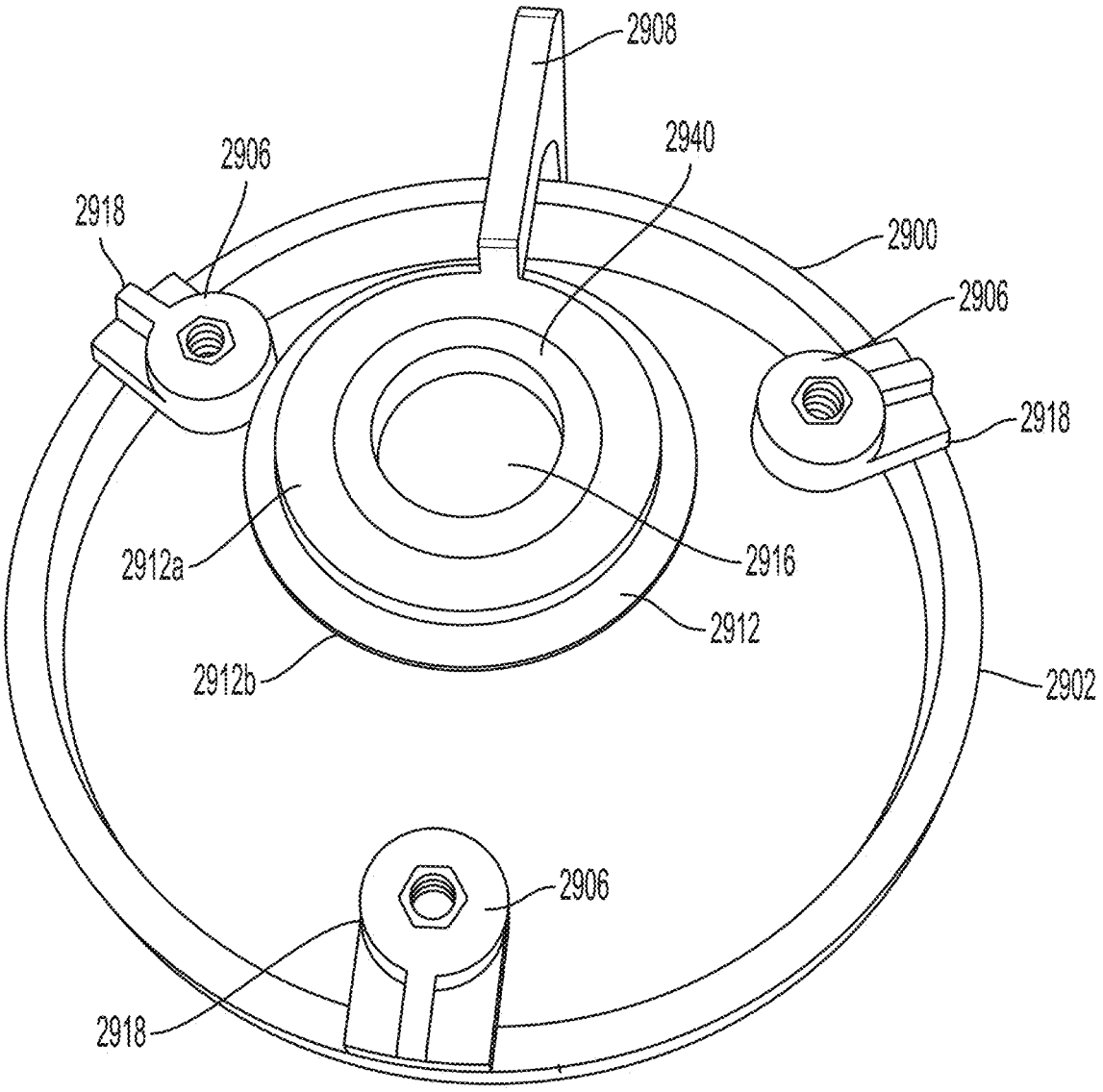
FIG. 29 is a front perspective view of another embodiment of a cup holder according to the present disclosure.

Referring to FIG. 29, a cup holder 2900 is shown. Cup holder 2900 is the same as cup holder 900 except cup holder 2900 has a support arm 2908 that does not include a portion of support arm 908 extending from cup holder hub 912 to second end 914, cup holder hub 2912 is shaped differently than cup holder hub 912, and cup holder 2900 has connectors 2906 that are shaped differently than connectors 906 to each have a curved shape inside an outer ring 2902. Cup holder hub 2912 has a first section 2912*a* that is thicker than a second section 2912*b* and a fitting 2940 fits inside of a hole 2916 through first section 2912*a*. Outer ring 2902 is the same as outer ring 902. Cup holder 2900 operates similar to cup holder 900 so that cup holder 2900 is connected in cup holder assembly 24 by each of connectors 2906 connecting to one of cup holder guide rods 26. Each of connectors 2906 connects to one of cup holder guide rods 26 by, for example, screw threading on each of connectors 2906 that mates with screw threading on each of cup holder guide rods 26, screw threads on cup holder guide rods 26 that each pass through one of holes 2918 in connectors 2906 and then receive a nut, snap fit or other fastener configurations. Mixer shaft with blade assembly 21 passes through outer ring 2902. Mixer shaft with blade assembly 21 passes through hole 2916 through first section 2912*a*. During operation, once connectors 2906 of cup holder 2900 contact rim 1002 that surrounds opening 1004 into of cup 1000 and outer ring 2902 moves below rim 1002 so that outer ring 2902 provides structural rigidity to cup holder 2900 but does not contact rim 1002, mixer shaft with blade assembly 21 can continue to move in cup 1000 while cup holder 2900 is maintained in position applying a downward pressure on cup 1000 to minimize or prevent vertical, horizontal and rotational movement of cup 1000 during blending and/or mixing. Mixer motor 20 rotates the blade of mixer shaft with blade assembly 21 in cup 1000. After blending/mixing is complete, motor mount 22 and mixer motor mount bracket 23 move along linear rail actuator system 3 to move mixer shaft with blade assembly 21 and cup holder assembly 24 away from cup 1000 back to the initial position.

Figure 30:
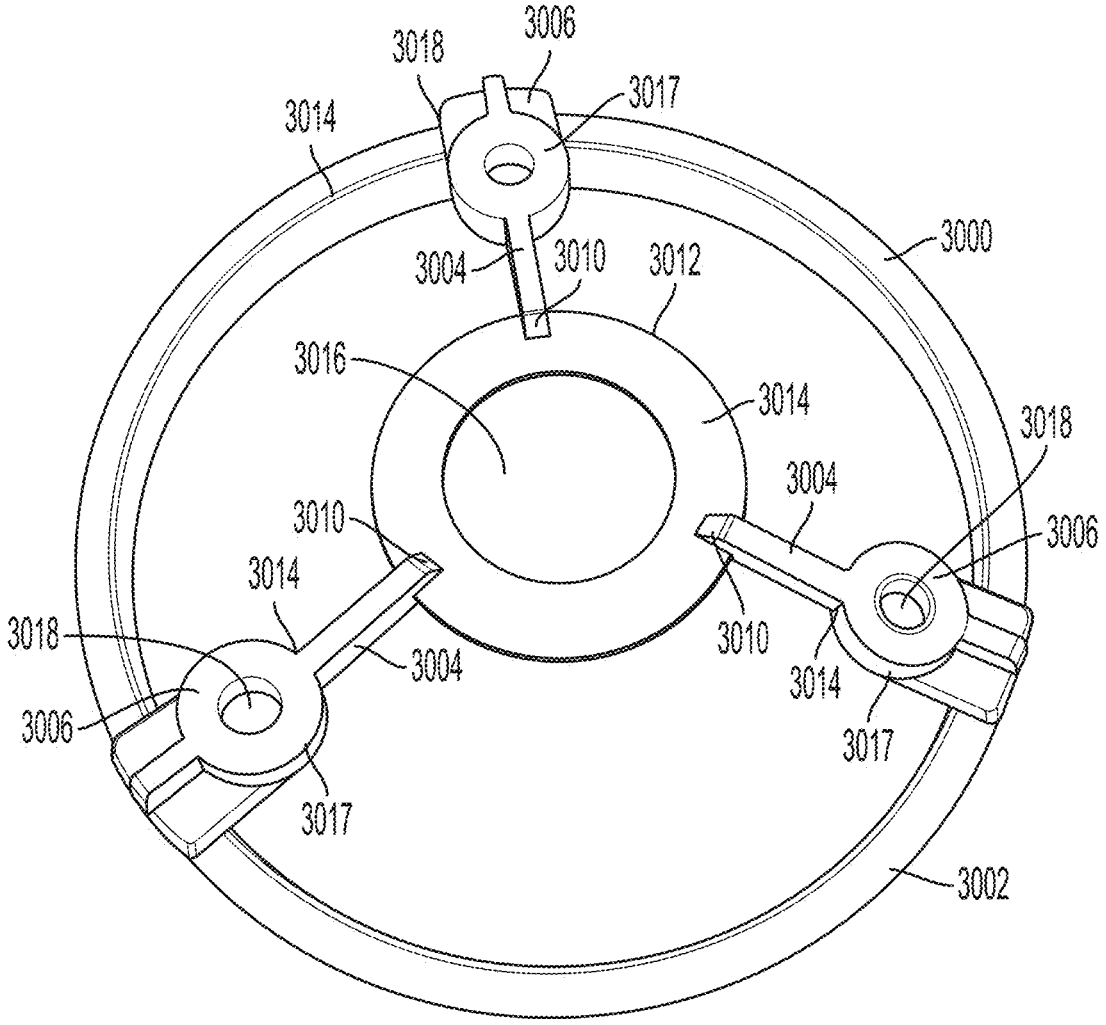
FIG. 30 is a front perspective view of another embodiment of a cup holder according to the present disclosure.
Figure 31:
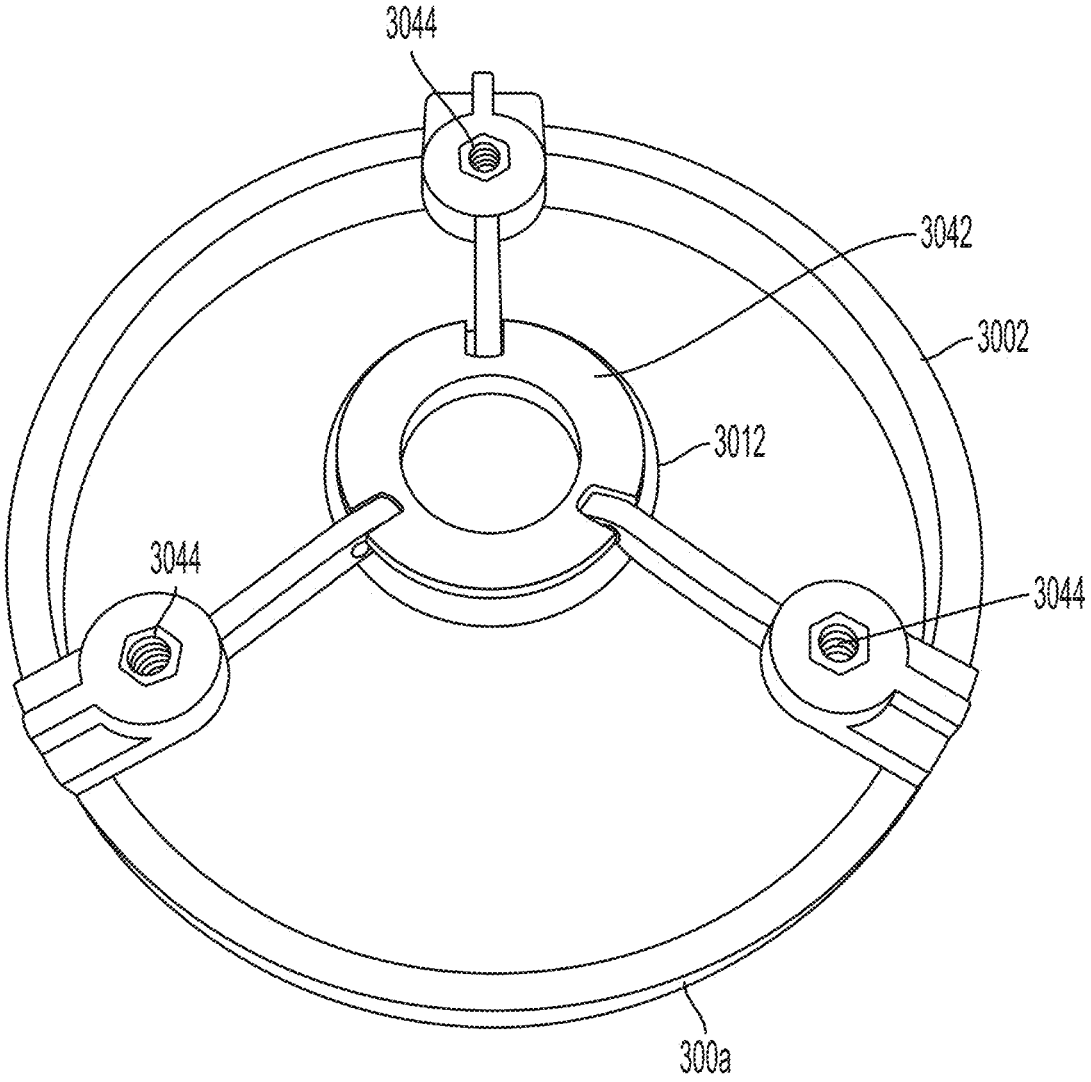
FIG. 31 is a top perspective view of the cup holder of FIG. 30 that is modified.

Referring to FIG. 30, another embodiment of a cup holder 3000 is shown. Cup has supports arms 3004, a cup holder hub 3012, connectors 3006 and an outer ring 3002. Each of supports arms 3004 has a first end 3010 and a second end 3014 with first end 3010 that is connected to cup holder hub 3012 and second end 3014 connected to one of connectors 3006. Connectors 3006 each have a connector body 3017. Connectors 3006 each have a passage 3018 through connector body 3017. Cup holder hub 3012 has a disk shape body 3014. Cup holder hub 3012 has a hole 3016 through disk shape body 3014. Referring to FIG. 31, cup holder 3000 can be modified to cup holder 3000*a* to add a fitting 3042 and threads 3044 inside each passage 3018. Referring to FIG. 34, cup holder 3000 can be modified to cup holder 3000*b* so that hole 3016 has scalloped edges.

Cup holder 3000 is connected in cup holder assembly 24 by each of connectors 3006 connecting to one of cup holder guide rods 26. Each of connectors 3006 can connect to one of cup holder guide rods 26 by, for example, screw threading on each of connectors 3006 that mates with screw threading on each of cup holder guide rods 26, screw threads on cup holder guide rods 26 that each pass through one of holes 3018 in connectors 3006 and then receive a nut, snap fit or other fastener configurations. Mixer shaft with blade assembly 21 passes through hole 3016 of cup holder hub 3012. During operation, once connectors 3006 contact rim 1002 that surrounds opening 1004 into of cup 1000 and outer ring 3002 moves below rim 1002 so that outer ring 3002 provides structural rigidity to cup holder 3000 but does not contact rim 1002, mixer shaft with blade assembly 21 can continue to move in cup 1000 while cup holder 3000 is maintained in position applying a downward pressure on cup 1000 to minimize or prevent vertical, horizontal and rotational movement of cup 1000 during blending and/or mixing. Mixer motor 20 rotates the blade of mixer shaft with blade assembly 21 in cup 1000. After blending/mixing is complete, motor mount 22 and mixer motor mount bracket 23 move along linear rail actuator system 3 to move mixer shaft with blade assembly 21 and cup holder assembly 24 away from cup 1000 back to the initial position.

Figure 32:
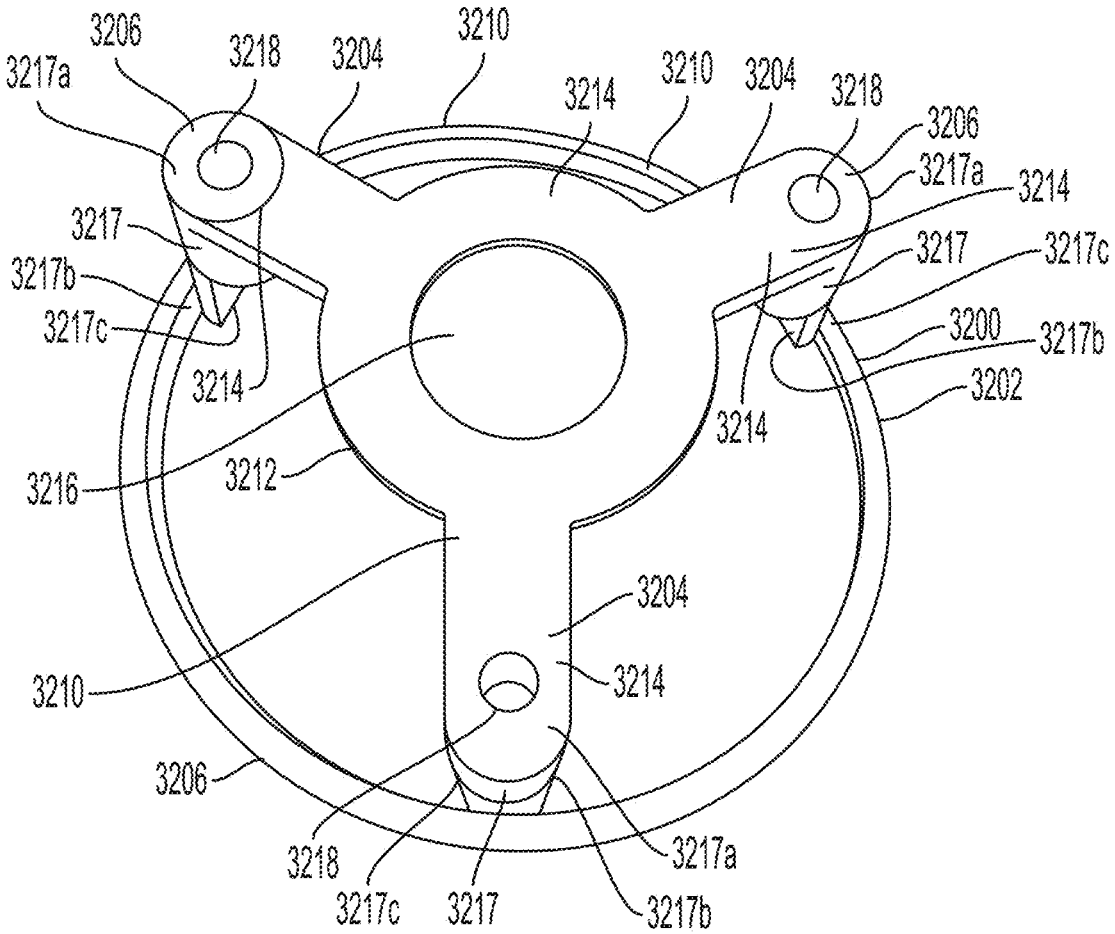
FIG. 32 is a front perspective view of another embodiment of a cup holder according to the present disclosure.

Referring to FIG. 32, another embodiment of a cup holder 3200 is shown. Cup holder 3200 has supports arms 3204, a cup holder hub 3212, connectors 3206 and an outer ring 3202. Each of supports arms 3204 has a first end 3210 and a second end 3214 with first end 3210 that is connected to cup holder hub 3212 and second end 3214 connected to one of connectors 3206. Connectors 3206 each have a connector body 3217. Connectors 3206 each have a passage 3218 through connector body 3217. Each connector body 3217 has a cylinder 3217*a* connected to a vertical member 3217*b* that connects to outer ring 3202 by a horizontal member 3217*c*. Cup holder hub 3212 has a disk shape body 3214. Cup holder hub 3212 has a hole 3216 through disk shape body 3214.

Cup holder 3200 is connected in cup holder assembly 24 by each of connectors 3206 connecting to one of cup holder guide rods 26. Each of connectors 3206 can connect to one of cup holder guide rods 26 by, for example, screw threading on each of connectors 3206 that mates with screw threading on each of cup holder guide rods 26, screw threads on cup holder guide rods 26 that each pass through one of holes 3218 in connectors 3206 and then receive a nut, snap fit or other fastener configurations. Mixer shaft with blade assembly 21 passes through hole 3216 of cup holder hub 3212. During operation, once connectors 3206 contact rim 1002 that surrounds opening 1004 into of cup 1000 and outer ring 3202 moves below rim 1002 so that outer ring 3202 provides structural rigidity to cup holder 3200 but does not contact rim 1002, mixer shaft with blade assembly 21 can continue to move in cup 1000 while cup holder 3200 is maintained in position applying a downward pressure on cup 1000 to minimize or prevent vertical, horizontal and rotational movement of cup 1000 during blending and/or mixing. Mixer motor 20 rotates the blade of mixer shaft with blade assembly 21 in cup 1000. After blending/mixing is complete, motor mount 22 and mixer motor mount bracket 23 move along linear rail actuator system 3 to move mixer shaft with blade assembly 21 and cup holder assembly 24 away from cup 1000 back to the initial position.

Figure 33:
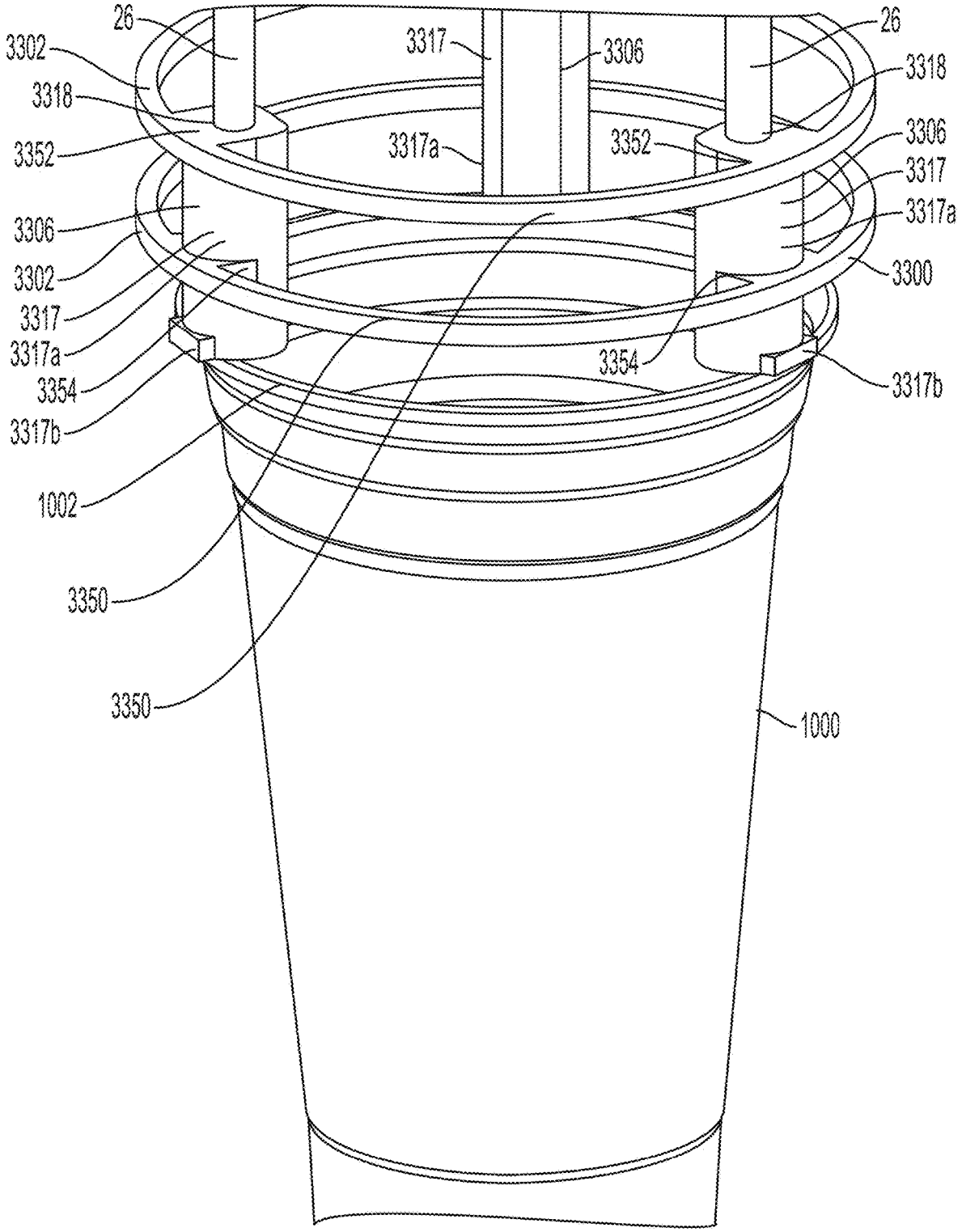
FIG. 33 is a front perspective view of another embodiment of a cup holder according to the present disclosure.

Referring to FIG. 33, another embodiment of a cup holder 3300 is shown. Cup holder 3300 has connectors 3306 and outer rings 3302. Connectors 3306 each have a connector body 3317. Connectors 3306 each have a passage 3318 through connector body 3317. Each connector body 3317 has a cylinder 3317*a* connected to a horizontal member 3317*b*. Each of outer rings 3302 has a ring body 3350. One of outer rings 3302 has an upper connecting portion 3352 connects to an upper portion of each connector 3306. Another of outer rings 3302 has a lower connecting portion 3354 that connects to a lower portion of each connector 3306.

Cup holder 3300 is connected in cup holder assembly 24 by each of connectors 3306 connecting to one of cup holder guide rods 26. Each of connectors 3306 can connect to one of cup holder guide rods 26 by, for example, screw threading on each of connectors 3306 that mates with screw threading on each of cup holder guide rods 26, screw threads on cup holder guide rods 26 that each pass through one of holes 3318 in connectors 3306 and then receive a nut, snap fit or other fastener configurations. Mixer shaft with blade assembly 21 passes through outer rings 3302. During operation, once connectors 3206 and/or horizontal members 3317*b* contact rim 1002 that surrounds opening 1004 into of cup 1000, mixer shaft with blade assembly 21 can continue to move in cup 1000 while cup holder 3300 is maintained in position applying a downward pressure on cup 1000 to minimize or prevent vertical, horizontal and rotational movement of cup 1000 during blending and/or mixing. Mixer motor 20 rotates the blade of mixer shaft with blade assembly 21 in cup 1000. After blending/mixing is complete, motor mount 22 and mixer motor mount bracket 23 move along linear rail actuator system 3 to move mixer shaft with blade assembly 21 and cup holder assembly 24 away from cup 1000 back to the initial position.

Referring to FIGS. 36 and 37, blender/mixer/cleaner module 4, 104 can be modified to have a nozzle 3600. Nozzle 3600 rinses blender blade 21*c* and bell housing 21*a* during cleaning. Nozzle 3600 has a bottom narrower spray pattern that does not contact cup holder 900, 1500, 2100, 2600, 2900, 3000, 3200, 3300 in a rinse position. Nozzle 3600 can eliminate spray from contacting cup holder 900, 1500, 2100, 2600, 2900, 3000, 3200, 3300. Nozzle 3600 only needs to clean an under side of blender blade 21*c* and bell housing 21*a*. Shaft 21*b* and a top side of bell housing 21*a* are rinsed by nozzles 1200 and 1202 of FIG. 12. Nozzle 3600 can have a lower velocity to form a fountain, similar to a drinking fountain, to rinse blender blade 21*c* and bell housing 21*a* and be directed vertically upward. Nozzle 3600 can form a 45 degree spray angle, as shown in FIG. 36, or a 30 degree spray angle, as shown in FIG. 37.

Cup holder 900, 1500, 2100, 2600, 2900, 3000, 3200, 3300 holds cup 1000 during mixing or blending otherwise cup 1000 will lift due to mixing or blending. Cup holder 900, 1500, 2100, 2600, 2900, 3000, 3200, 3300 also limits rotation of cup 1000 which minimizes or prevents ingredients from being flung out of cup 1000 during rotation. Blending profiles are specifically designed to process the drink in the bottom of cup 1000 when using cup holder 900, 1500, 2100, 2600, 2900, 3000, 3200, 3300 that does not completely prevent ingredients from coming out of cup 1000 during mixing or blending. Blending profiles are specifically designed to process the drink using cup holder 900, 1500, 2100, 2600, 2900, 3000, 3200, 3300 to blend or mix with a velocity of blade 21*c* that maintains the ingredients in cup 1000.

While the present disclosure has been described with reference to one or more exemplary embodiments, it will be understood by those skilled in the art, that various changes can be made, and equivalents can be substituted for elements thereof without departing from the scope of the present disclosure. In addition, many modifications can be made to adapt a particular situation or material to the teachings of the present disclosure without departing from the scope thereof. Therefore, it is intended that the present disclosure will not be limited to the particular embodiments disclosed herein, but that the disclosure will include all aspects falling within the scope of a fair reading of appended claims.

What is claimed is:

1. A beverage dispensing machine, comprising:

a cup holder, wherein the cup holder has an outer ring defining an interior area and an opening in the outer ring, wherein the opening occupies a majority of the interior area, wherein the cup holder further comprises a plurality of discontinuous connectors around the outer ring;

a mixer comprising a shaft and a blade;

one or more cup holder guide rods;

a housing; and an actuator operably connected to the mixer and one or more cup holder guide rods, wherein the actuator moves the mixer and the one or more cup holder guide rods so that the plurality of cup holder guide rods extend into the housing, and each of the cup holder guide rods connects to one of the plurality of connectors.

2. The cup holder assembly of claim 1, wherein the opening occupies 80-95% of the interior area.

3. The machine of claim 1, further comprising a support arm, wherein the support arm has a first end, a cup holder hub, and a second end, and wherein the first end is connected to the outer ring and the second end is connected to one of the plurality of connectors on an opposite side of the outer ring that is connected to the first end.

4. The machine of claim 3, wherein the cup holder hub has a disk shape body that is between the first end and the second end of the support arm, and wherein the cup holder hub has a hole through the disk shape body.

5. The machine of claim 4, wherein each of the plurality of connectors has a connector body extending upward and inward from the outer ring, and wherein each of the plurality of connectors have a hole through the connector body.

6. The machine of claim 4, wherein each of the plurality of connectors has a connector body, wherein the connector body has a cylinder connected to a horizontal member and a vertical member extending the cylinder upward and inward from the outer ring, and wherein each of the plurality of connectors have a hole through the connector body.

7. The machine of claim 1, further comprising a support arm that extends between the outer ring and a cup holder hub.

8. The machine of claim 7, wherein each of the plurality of connectors has a connector body, wherein the connector body has a cylinder connected to a horizontal member and a vertical member extending the cylinder upward and inward from the outer ring, and wherein each of the plurality of connectors have a hole through the connector body.

9. The machine of claim 1, further comprising one or more nozzles connected to the housing above at least a portion of the cup holder.

10. The assembly of claim 1, further comprising a single nozzle below at least a portion of the cup holder that generates a spray vertically upward.

11. A method of blending or mixing a beverage with the machine of claim 1, the steps comprising:

blending or mixing in a cup according to a blending profile mixer, wherein the mixer has an initial position, the blending or mixing having a first speed at a first position that is greater than a second speed at a second position according to the blending profile, the first position having a first distance from the initial position, the second position having a second distance from the initial position, the first distance being greater than the second distance.

12. The method of claim 11, wherein the first distance is located at a bottom of the cup, and wherein the mixer only has a maximum speed when the mixer is positioned at the bottom of the cup according to the blending profile.

13. The method of claim 12, wherein, when the mixer is moved upward from the bottom of the cup to the second position, then the mixer blends or mixes at a slower speed than when at the bottom of the cup according to the blending profile.

14. The method of claim 12, wherein the blending profile starts and ends with the mixer at the initial position that is then moved one or more times between the first position and the second position, and wherein the blade of the mixer blends or mixes at the maximum speed only when in the first position.

* * * * *